US005486899A

United States Patent [19]

Iimori et al.

[11] Patent Number: 5,486,899

[45] Date of Patent: Jan. 23, 1996

[54] IMAGE FORMING APPARATUS HAVING A FUNCTION OF IDENTIFYING A TONER CARTRIDGE

[75] Inventors: Akiro Iimori; Kazushige Morihara, both of Yokohama, Japan

[73] Assignee: Kabushiki Kaisha Toshiba, Kawasaki, Japan

[21] Appl. No.: 256,351

[22] PCT Filed: Jan. 20, 1993

[86] PCT No.: PCT/JP93/00059

§ 371 Date: Jul. 18, 1994

§ 102(e) Date: Jul. 18, 1994

[87] PCT Pub. No.: WO93/15445

PCT Pub. Date: Aug. 5, 1993

[30] Foreign Application Priority Data

Jan. 22, 1992 [JP] Japan ..... 4-009180
Sep. 24, 1992 [JP] Japan ..... 4-254873

[51] Int. Cl.[6] ..... G03G 15/00; G03G 15/06

[52] U.S. Cl. ..... 355/203; 355/260; 340/825.34; 380/23

[58] Field of Search ..... 355/203, 260; 340/825.34; 380/23

[56] References Cited

U.S. PATENT DOCUMENTS 5,075,724 12/1991 Wada et al. ..... 355/203
5,132,729 7/1992 Matsushita et al. ..... 355/203

FOREIGN PATENT DOCUMENTS 63-193156 8/1988 Japan .
2-72381 3/1990 Japan .
2-61656 3/1990 Japan .
2-93480 4/1990 Japan .
3-134684 6/1991 Japan .

*Primary Examiner*—Joan H. Pendegrass
*Attorney, Agent, or Firm*—Foley & Lardner

[57] ABSTRACT

A control section 81 of a PPC outputs a request signal having a command that designates an encrypting rule to a cartridge CPU 45*f* of a toner cartridge. The control section 81 receives a response signal based on the output of the request signal from the cartridge CPU 45*f*, and collates the response signal with identification data in a ROM 82. The conformability of the toner cartridge is discriminated in accordance with whether or not the response signal received from the cartridge CPU 45*f* corresponds to the encrypting rule designated by the command of the request signal.

7 Claims, 15 Drawing Sheets

IMAGE FORMING APPARATUS HAVING A FUNCTION OF IDENTIFYING A TONER CARTRIDGE

FIELD OF THE INVENTION

The present invention relates to an image forming apparatus, such as a copying apparatus, having a developing-agent replenishing device used as an exchangeable device, such as a toner cartridge, for replenishing a toner (developing agent) to a developing device that visualizes, for example, an electrostatic latent image with the toner.

BACKGROUND ART

In recent years, a copying apparatus in which a toner cartridge is mounted on a developing device and a toner is replenished from the toner cartridge has been put to practical use.

A copying apparatus of this type has a removable toner cartridge. The cartridge is exchanged when the toner in the cartridge runs out.

Generally, in the copying apparatus of this type, it is preferable to use a toner cartridge the manufacturer guarantees in accordance with the structure and standards of the machine frame.

In most conventional copying apparatuses, however, the toner density in the developing device is checked, and toner replenishment from the cartridge is controlled. When the toner density does not reach a predetermined value even after toner replenishment has been performed for a predetermined period of time, it is instructed that the user exchange the cartridge.

Since it is the user who exchanges the toner cartridge, a standard cartridge guaranteed by the manufacturer is not always used.

Even when a non-guaranteed toner cartridge (other than the standard product) is used, a certain degree of copying performance is ensured. In this case, however, the performance of the copying apparatus is not fully attained, and a trouble may be caused.

In the field of the copying apparatus, a technique of detecting whether or not a developing device has been installed in the full-color copying machine has already been proposed, as is disclosed in, for example, Jpn. Pat. Appln. KOKAI Publication No. 2-93480.

Also, Jpn. Pat. Appln. KOKAI Publication No. 63-193156, for example, discloses an image forming apparatus, in which a specific binary pattern identification number marked at one end of a unit integrally comprising a photosensitive drum and a developing device is read when the unit is mounted in the main body, so that a mounting error of the unit can be recognized.

However, the arrangement for identifying the developing devices according to these proposals can be easily imitated. A strong demand has arisen for an appropriate countermeasure for a toner cartridge that can be imitated more easily than the developing device.

DISCLOSURE OF INVENTION

It is, therefore, an object of the present invention to provide an image forming apparatus which can suppress degradation in performance and occurrence of troubles caused when a replenishing device is not a standard product guaranteed by the manufacturer.

To achieve the above object, according to the invention there is provided an image forming apparatus having a developing device designed to develop an electrostatic latent image formed on an image carrier, by supplying a developing agent onto the electrostatic latent image. The image forming apparatus comprises a developing-agent replenishing device detachably connected to the developing device. The replenishing device comprises: a storage section for storing a developing agent; a supply section for supplying the developing agent from the storage section to the developing device; first input means for receiving a first data signal; memory means storing a plurality of processing rules based on which the first data signal input through the first input means is to be processed; processing means for performing a processing on the first data signal input from the first input means, based on the processing rules stored in the memory means, thereby to generate a second data signal; and first output means for outputting the second data signal generated by the processing means. The image forming apparatus further comprises: generating means for generating data for selecting a specific one of the plurality of processing rules stored in the memory means; second output means for outputting to the first input means the data generated by the generating means for selecting the specified one of the plurality of processing rules and also the first data signal when the developing-agent replenishing device is connected to the developing device; second input means for receiving the second data signal generated by the processing means and output from the first output means, when the developing-agent replenishing device is connected to the developing device; and discriminating means for comparing the second data signal input through the second input means with the first data signal, thereby to discriminating conformability of the developing-agent replenishing device, when the developing-agent replenishing device is connected to the developing device.

According to the present invention, there is provided another image forming apparatus having a developing device designed to develop an electrostatic latent image formed on an image carrier, by supplying a developing agent onto the electrostatic latent image. The developing-agent replenishing device is detachably connected to the developing device and comprises: a storage section for storing a developing agent; a supply section for supplying the developing agent from the storage section to the developing device; first input means for receiving a data signal which has a command part and a data part; first memory means storing a plurality of processing rules which correspond to types of the command part of the first data signal and based on which the data part of the first data signal is to be processed; processing means for reading the processing rule corresponding to the type of the command part of the first data and for performing a prescribed processing based on the processing rules read out, on the first data signal input through the input means, thereby to generate a second data signal; and first output means for outputting the second data signal generated by the processing means. The image forming apparatus further comprises: second output means for outputting the first data signal having the command part and the data part to the first input means; second memory means storing a third data signal corresponding to the command part of the first data signal output from the second output means; second input means for receiving the second data signal generated by the processing means and output form the first output means; and comparing means for comparing the second data signal input from the second input means with the third data signal corresponding to the command part of the first data signal and stored in the memory means; and discriminating means for discriminating conformability of the developing-agent replenishing device in accordance with result of comparison performed by the comparing means.

According to this invention, there is provided still another image forming apparatus which comprises: exposure means for exposing to light an original placed on an original table; latent-image forming means for forming a latent electrostatic image of the original on an image carrier by guiding the image from the original placed on the original table and exposed to light by means of the exposure means; developing means having a storage chamber for containing a developing agent and designed to applying the developing agent from the storage chamber onto the latent electrostatic image formed on the image carrier, thereby to develop the image; detector means contained in the storage chamber of the developing means and designed to detect an amount of the developing agent stored in the storage chamber; a developing-agent replenishing device comprising a storage section detachably connected to the developing means, for storing the developing agent, a supply section for supplying the developing agent from the storage section into the storage chamber of the developing means, first input means for receiving a first data signal, memory means storing a plurality of processing rules based on which the first data signal input through the first input means is to be processed, processing means for performing a processing on the first data signal input from the first input means, based on the processing rules stored in the memory means, thereby to generate a second data signal, and first output means for outputting the second data signal generated by the processing means; generating means for generating data for selecting a specific one of the plurality of processing rules stored in the memory means; second output means for outputting to the first input means the data generated by the generating means for selecting the specified one of the plurality of processing rules and also the first data signal when the developing-agent replenishing device is connected to the developing device; second input means for receiving the second data signal generated by the processing means and output from the first output means, when the developing-agent replenishing device is connected to the developing device; and discriminating means for comparing the second data signal input through the second input means with the first data signal, thereby to discriminating conformability of the developing-agent replenishing device, when the developing-agent replenishing device is connected to the developing device; and control means for causing the supply section to supply the developing agent to the storage chamber of the developing means when the discriminating means determines that the developing-agent replenishing device connected to the developing device is conformable and when the detector means detects that the amount of the developing agent stored in the storage chamber of the developing means has decreased, and for inhibiting the supply section from supplying the developing agent to the developing device, regardless of the result of the detection performed by the detector means, when the discriminating means determines that the developing-agent replenishing device connected to the developing device is not conformable.

BEST MODE OF CARRYING OUT THE INVENTION

The embodiments of the present invention will be described, with reference to the accompanying drawings.

Figure 1:
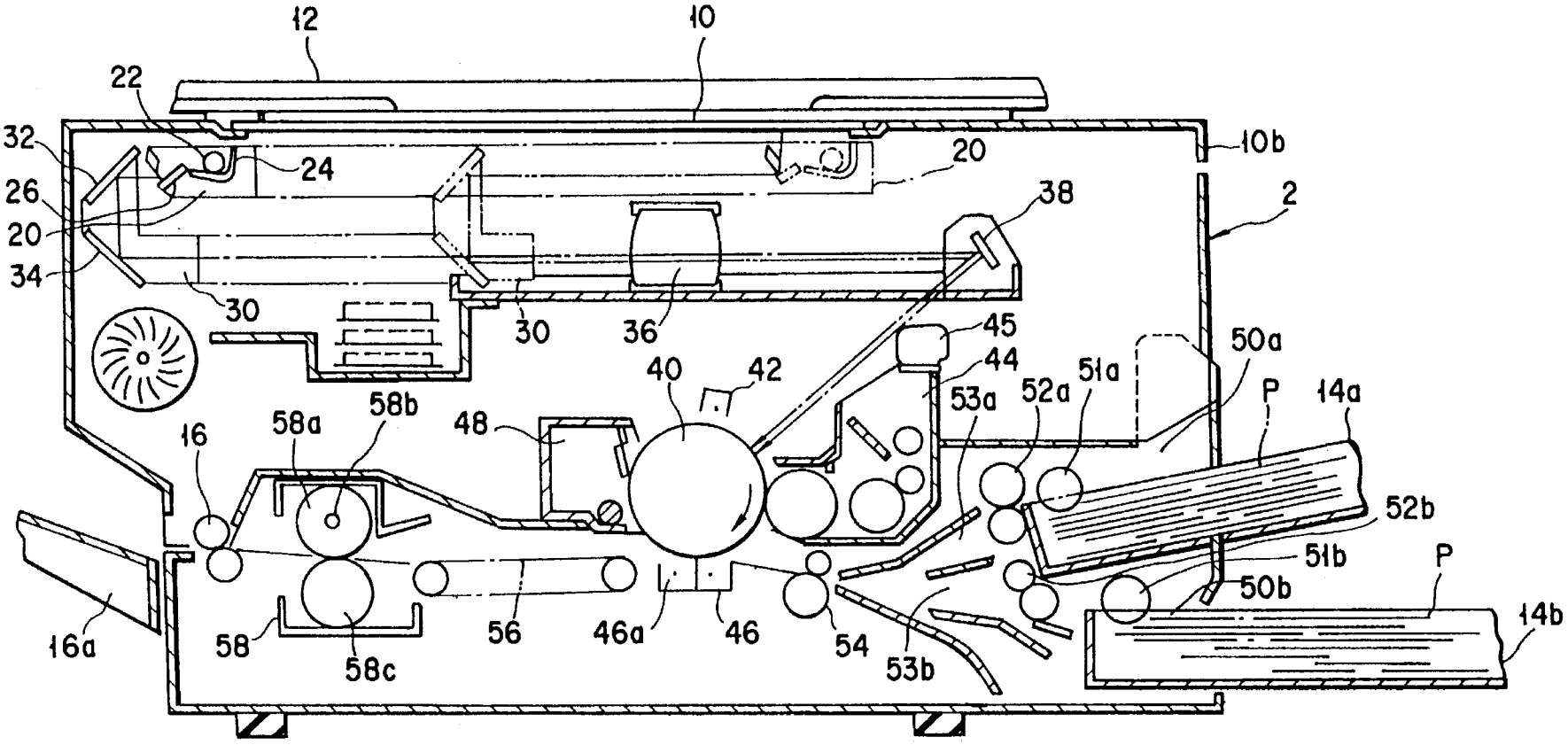
FIG. 1 is a diagram showing the arrangement of an image forming apparatus, i.e., a copying apparatus, according to an embodiment of the present invention.

FIG. 1 schematically shows the arrangement of a copying apparatus according to an embodiment of the present invention.

A copying apparatus (PPC) 2 has an original table (transparent glass plate) 10 for supporting an object to be read, i.e., an original, an upper cover 10*b* surrounding the original table 10, and an openable/closable original cover 12 for holding the original on the original table 10.

The upper cover 10*b* has an operation panel (to be described later) to be operated by the user to input an operation signal and the like.

Located in the original table 10, i.e., in the main body of the PPC 2, are: a first carriage 20 having a lamp 22 for illuminating the original, a reflecting plate 24 for focusing the illumination light generated by the lamp 22 on the original, and a first mirror 26 for reflecting light reflected by the original, and a second carriage 30 having second and third mirrors 32 and 34 for reflecting light reflected by the first carriage 20 from the original.

The first carriage 20 can be moved by a pulse motor (not shown) through a toothed belt (not shown) or the like, in parallel to the original table 10.

The second carriage 30 can be moved, through the toothed belt (not shown) or the like for driving the first carriage 20, to follow the first carriage 20 at half (½) the speed of the first carriage 20.

An image formation lens 36 is provided below the first carriage 20 within a plane including the optical axis of the reflected light returned by the second carriage 30. The lens 36 can be moved by a driving mechanism (not shown), focuses the reflected light from the second carriage 30. When moved, it forms an image of the reflected light at a desired magnification.

A fourth mirror 38 returns this reflected light, forms an image of the reflected light at a desired position on a photosensitive body 40. The mirror 38 can be moved by a driving mechanism (not shown) along the optical axis to compensate for a variation in focal length which occurs as the image formation lens 36 is moved.

The reflected light represents a character or figure written on the original, i.e., image information of the original, as a matter of course.

The photosensitive body 40 is arranged below the image formation lens 36 and near the center of the PPC 2. When the reflected light guided by the fourth mirror 38 forms an image on the photosensitive body 40, an electric charge distribution pattern, i.e., an electrostatic latent image, is formed on the photosensitive body 40.

A charging unit 42, a developing unit 44, a transfer unit 46, and a cleaning unit 48 are disposed around the photosensitive body 40 in the order named. The charging unit 42 applies a predetermined amount of charges on the photosensitive body 40. The developing unit 44 visualizes the electrostatic latent image formed on the photosensitive body 40 with a toner (developing agent). The transfer unit 46 transfers a toner image formed on the photosensitive body 40 on a copy paper sheet P serving as an image-to-be-formed member supplied from a paper feed device (to be described later). The cleaning unit 48 removes the charge distribution on the photosensitive body 40 after transfer to initialize the charging characteristics of the photosensitive body 40, and scrapes away the residual toner.

A toner cartridge (to be described later in detail) 45 serving as a replenishing means for storing the toner and replenishing the toner in the consumed amount is detachably mounted on the developing unit 44.

The transfer unit 46 integrally has an AC voltage applying unit 46*a* for separating the paper sheet P after transfer from the photosensitive body 40.

In this manner, the latent image formed on the photosensitive body 40 is transformed into a toner image by the developing unit 44. The image information contained in the original is thus copied as the toner image and formed on the paper sheet p.

More specifically, a plurality of slots 50*a* and 50*b* for respectively receiving paper cassettes 14*a* and 14*b* serving as the paper feed devices are formed in the right portion of the PPC 2, i.e., at a position corresponding to the upstream side of the rotational direction of the photosensitive body 40.

A discharge tray 16*a* for stocking copied paper sheet P on which the image formed on the photosensitive body 40 has been transferred and fixed is disposed in the left side surface portion of the PPC 2.

First and second paper feed rollers 51*a* and 51*b* for picking up paper P one by one from the paper cassettes 14*a* and 14*b* are provided in the PPC 2 and at a position corresponding to the upstream side of the photosensitive body 40.

First and second pairs of convey rollers 52*a* and 52*b* are provided ahead of the first and second paper feed rollers 51*a* and 51*b*, for conveying the picked-up paper P toward the photosensitive body 40.

Convey paths 53*a* and 53*b* are provided ahead of the first and second pairs of convey rollers 52*a* and 52*b*. A pair of pair of timing rollers 54 are arranged for correcting the skew of the paper P, guided along the convey paths 53*a* and 53*b*, immediately before the photosensitive body 40, aligning the leading end of the image on the photosensitive body 40 with the leading end of the paper P, and conveying the paper P at the same speed as the rotational speed of the photosensitive body 40.

Furthermore, a conveying unit 56 for conveying paper P, on which the toner image on the photosensitive body 40 has been transferred and the toner is electrostatically attached, is provided at a position corresponding to the downstream side of the photosensitive body 40 of the PPC 2. A fixing unit 58 is disposed ahead of the conveying unit 56.

The fixing unit 58 is constituted by a hollow cylindrical heat roller 58*a* and a press roller 58*c*. The heat roller 58*a* houses a heater lamp 58*b* for heating the heat roller 58*a* and is driven at the same peripheral moving speed as the moving speed of the outer circumferential surface of the photosensitive body 40. The press roller 58*c* is urged against the heat roller 58*a* to apply a pressure to the heat roller 58*a* and the paper P, and fuses and fixes the toner.

A pair of discharge rollers 16 for discharging the copied paper sheet P, on which the toner image has been fixed when the paper P passes through the fixing unit 58, to the outside of the PPC 2 is provided ahead of the fixing unit 58.

The developing unit 44 is a two-component type developing unit. The developing unit 44 houses a two-component developing agent consisting of, e.g., a toner (fine powder resin) and a carrier, conveys the toner to the outer circumferential surface of the developing roller by attaching the toner to the carrier particles, forms a developing agent layer and brings it into contact with the surface of the photosensitive body 40, separates the toner from the carrier particles by the Coulomb force of the electrostatic latent image formed on the photosensitive body 40, and attaches the toner to the latent image portion.

Figure 2:
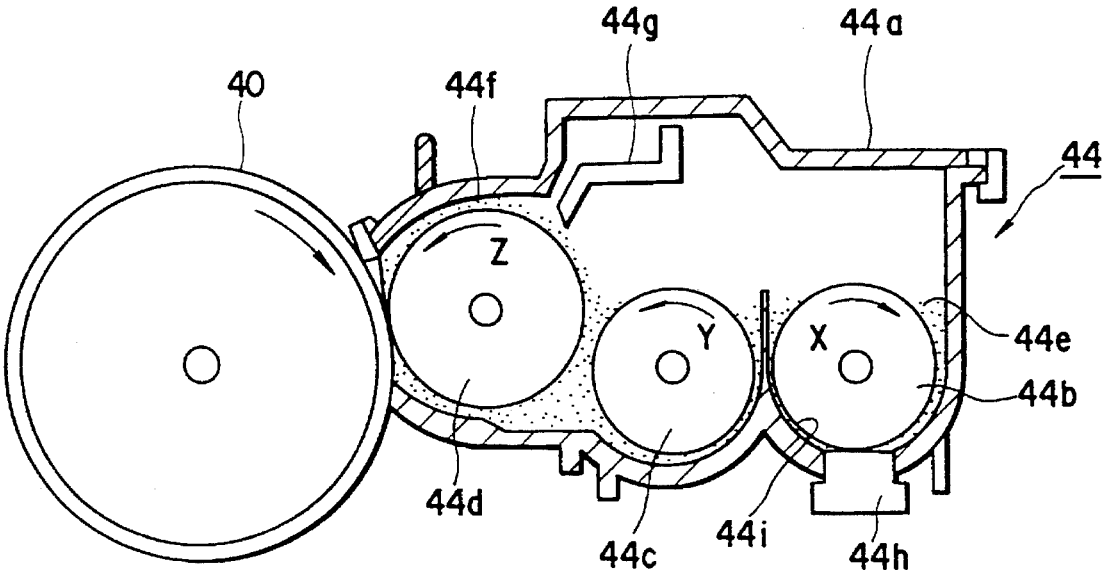
FIG. 2 is a diagram showing the arrangement of the developing device incorporated in the apparatus of FIG. 1.

FIG. 2 shows the arrangement of the two-component type developing unit 44 described above.

More specifically, a pair of convey rollers (mixers) 44*b* and 44*c* serving as developing agent conveying means having axes parallel to the axial direction of the photosensitive body 40, and a developing roller (magnet roller) 44*d* are provided in a casing 44*a*.

The conveying rollers 44*b* and 44*c*, and the developing roller 44*d* are rotated by driving systems (not shown) in directions indicated by arrows X, Y, and Z, respectively, in FIG. 2.

When a developing agent 44*e* filled in the casing 44*a* is conveyed to the developing roller 44*d* by rotation of the conveying rollers 44*b* and 44*c*, a developing agent layer 44*f* is formed on the outer circumferential surface of the developing roller 44*d*. The developing agent layer 44*f* is brought into contact with the surface of the photosensitive body 40, and the development as described above is performed.

Reference numeral 44*g* in FIG. 2 denotes a brush control blade (leveler) for uniforming the thickness of the developing agent layer 44*f* formed on the outer circumferential surface of the developing roller 44*d*.

A toner density sensor 44*h* is provided on the lower surface of the casing 44*a* to oppose the conveying roller 44*b* and detects the toner density of the developing agent 44*e* conveyed along a convey path 44*i*.

The developing unit 44 is formed as one unit and can be integrally mounted in and detached from the PPC 2.

Figure 3:
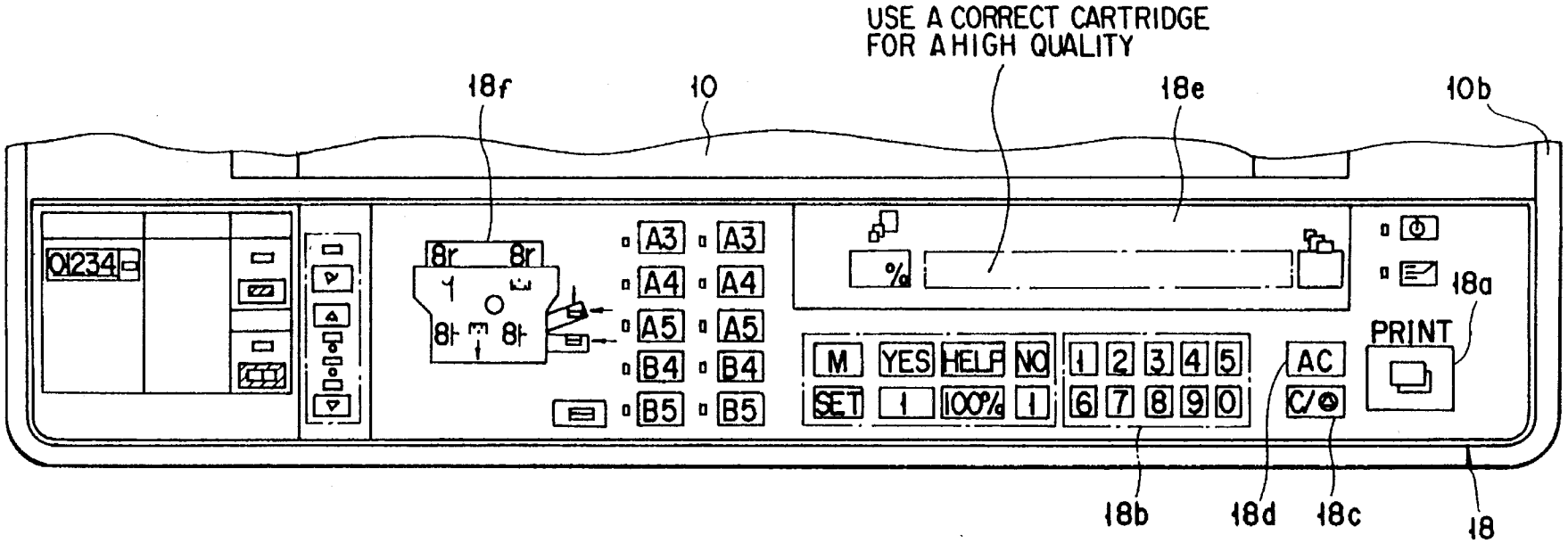
FIG. 3 is a plan view showing the arrangement of the operation panel used in the apparatus.

FIG. 3 shows an operation panel 18 formed on the upper cover 10*b*.

The operation panel 18 includes a print key 18*a* for inputting a copy start signal, "0" to "9" numerical keys (ten keys) 18*b* utilized for setting a copy count and inputting a data signal, a clear key 18*c* for interrupting a copying operation and resetting data being input, an all clear key 18*d* for restoring the preset copy mode to the initial state, and the like.

The operation panel 18 integrally incorporates a liquid crystal display (LCD) 18*e*, a monitor LED 18*f*, and the like. The LCD 18*e* can display input data (e.g., a copy count and a copy magnification) and simultaneously serves as a message display for displaying the operation sequence of the PPC 2, the replenishing timing of the paper sheet P or toner, an error message, or the like. The monitor LED 18*f* displays the operating state of the PPC 2, e.g., the selected cassette or a paper jamming position.

The basic copying operation of the PPC 2 will be described.

For example, copying conditions, e.g., a copy count, a copy magnification, a paper size, and the like are selected through the operation panel 18, and a copy start signal is input from the print key 18*a*. Then, the original placed on the original table 10 is irradiated with light from the lamp 22 while the original is read, i.e., while the first carriage 20 is moved forward.

The light reflected by the original is transmitted through the slit region formed by the reflecting plate 24 to be guided to the first mirror 26. Then, it is reflected toward the second mirror 32 of the second carriage 30.

The reflected light guided to the second mirror 32 is reflected by the third mirror 34 again to be guided to the image formation lens 36, is transformed into convergent light by the image formation lens 36, and forms an image, through the fourth mirror 38, on a predetermined position of the surface of the photo sensitive body 40 to which predetermined charges have been applied.

That is, the light reflected by the original is transformed into an electrostatic pattern on the surface of the photosensitive body 40 by slit exposure and becomes a latent image.

The image formed as the latent image on the photosensitive body 40 is guided to the developing region as the photosensitive body 40 is rotated at a desired moving speed. In this developing region, the toner is supplied from the developing unit 44. Thus, the toner is selectively attached to the latent image to develop the latent image.

Along with the series of operations described above, a cassette storing paper sheets P of the optimum size is selected from the paper cassettes 14*a* and 14*b* in accordance with the designated paper size or original size and the copy magnification. A sheet of paper P is picked up by the corresponding paper feed roller 51*a* or 51*b* from the selected cassette.

The paper sheet P is conveyed between the convey path 53*a* or 53*b* through the corresponding pair of conveying rollers 52*a* or 52*b* to be supplied, from the upstream side of the rotational direction of the photosensitive body 40, to the transfer region formed between the photosensitive body 40 and the transfer unit 46.

The paper sheet P is temporarily stopped by the pair of timing rollers 54 immediately before reaching the transfer region. Thereafter, the leading ends of the image and paper sheet p are aligned by referring to the movement of the first or second carriage 20 or 30 in the sub-scanning direction, and the paper sheet P is conveyed toward the photosensitive body 40.

When the toner image formed on the photosensitive body 40 is rotated at the desired speed and guided to the transfer region defined between the photosensitive body 40 and the transfer unit 46, the paper sheet P supplied from the pair of timing rollers 54 is attracted (to be in tight contact) by the photosensitive body 40 as it is attracted by the charges remaining on the photosensitive body 40. The paper sheet P is transmitted through the transfer region as the photosensitive body 40 is rotated.

At this time, charges having the same polarity as that of the charges already supplied to the photosensitive body 40 (for forming a latent image) are supplied from the transfer unit 46 to the photosensitive body 40 and the paper sheet P. As a result, the toner attaching to the photosensitive body 40 is transferred to the paper P.

When an AC voltage is applied from the AC voltage applying unit 46*a* integrally formed with the transfer unit 46 to the photosensitive body 40, the paper sheet P on which the toner is transferred is released from the photosensitive body 40 and conveyed to the conveying unit 56 with the toner on it. When the paper sheet P is transmitted between the heat roller 58*a* and the press roller 58*c* of the fixing unit 58, the toner is fixed on the paper sheet P.

When the image on the original is copied on the paper sheet P, in the manner as described above, the paper P is discharged by the pair of discharge rollers 16 to the discharge tray 16*a* (with its copy surface turned upward).

After the paper sheet P is separated from the photosensitive body 40, the photosensitive body 40 is further rotated and its surface is cleaned by the cleaning unit 48. More specifically, the remaining toner on the photosensitive body 40 is removed by the cleaning unit 48, and the charge distribution pattern on the surface of the photosensitive body 40 is restored to the initial state through a discharging lamp (not shown), so that the next copying operation enable state is maintained.

At this time, when, e.g., a degradation in toner density in the developing unit 44 is detected by the toner density sensor 44*h*, a toner convey motor (not shown) is driven, and the toner in the toner cartridge 45 is supplied to the conveying roller 44*b* white it is being agitated.

In this manner, the replenishing operation is continued until the toner density in the developing unit 44 reaches a predetermined level.

When the toner density does not reach the predetermined level even after the replenishing operation is performed for a predetermined period of time, toner empty, i.e., complete consumption of the toner in the toner cartridge 45 is determined.

Figure 4:
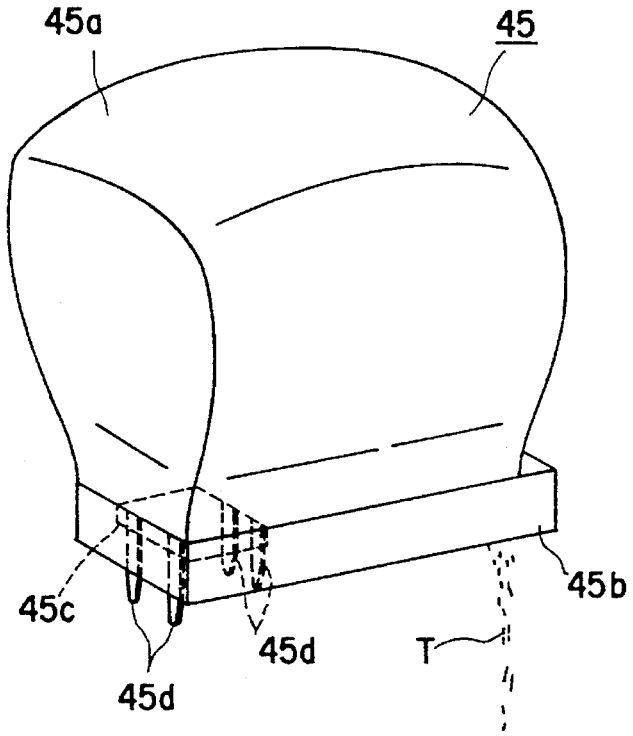
FIG. 4 is a perspective outer appearance view showing the arrangement of the toner cartridge used in the apparatus.

FIG. 4 shows an arrangement of the toner cartridge 45 described above.

The toner cartridge 45 is detachably mounted on the PPC 2 and is exchanged for a new cartridge when a toner T stored in the toner cartridge 45 runs out.

The toner cartridge 45 is constituted by a hopper portion (case main body) 45*a* for storing the replenishing toner T and a bottom portion 45*b* having a replenishing port (not shown).

The hopper portion 45*a* and the bottom portion 45*b* are firmly bonded to each other by an adhesive or the like after the toner T is filled in the hopper portion 45*a*.

Figure 5:
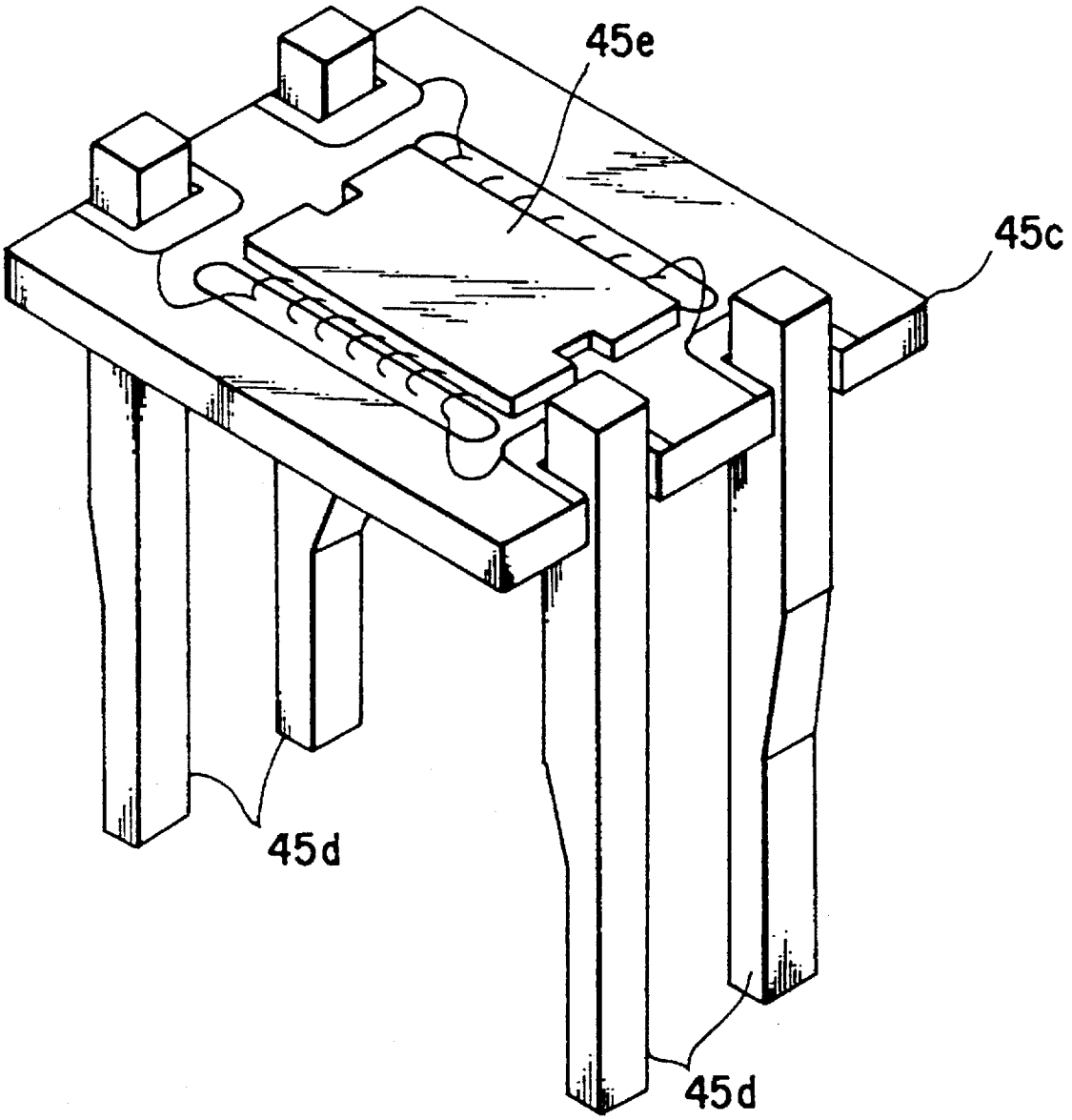
FIG. 5 is a perspective view showing an example of a control PC board provided in the toner cartridge.

The bottom portion 45b is integrally hermetically formed with a control PC board 45c, as shown in FIG. 5, with a predetermined filler. Hence, an integrated circuit 45e and the like mounted on the control PC board 45c are protected from damages or erroneous operations caused by the toner T.

Four lead pins 45d extend from the control PC board 45c and project downward from the lower surface of the bottom portion 45b. Hence, when the toner cartridge 45 is to be mounted on the developing unit 44, the control PC board 45c is electrically connected to the control section of the PPC 2 through a connector (not shown) or the like.

More specifically, the toner cartridge 45 communicates with the main CPU (to be described later) of the PPC 2 so that whether or not the toner cartridge 45 conforms to the PPC 2 is discriminated (determined).

Figure 6:
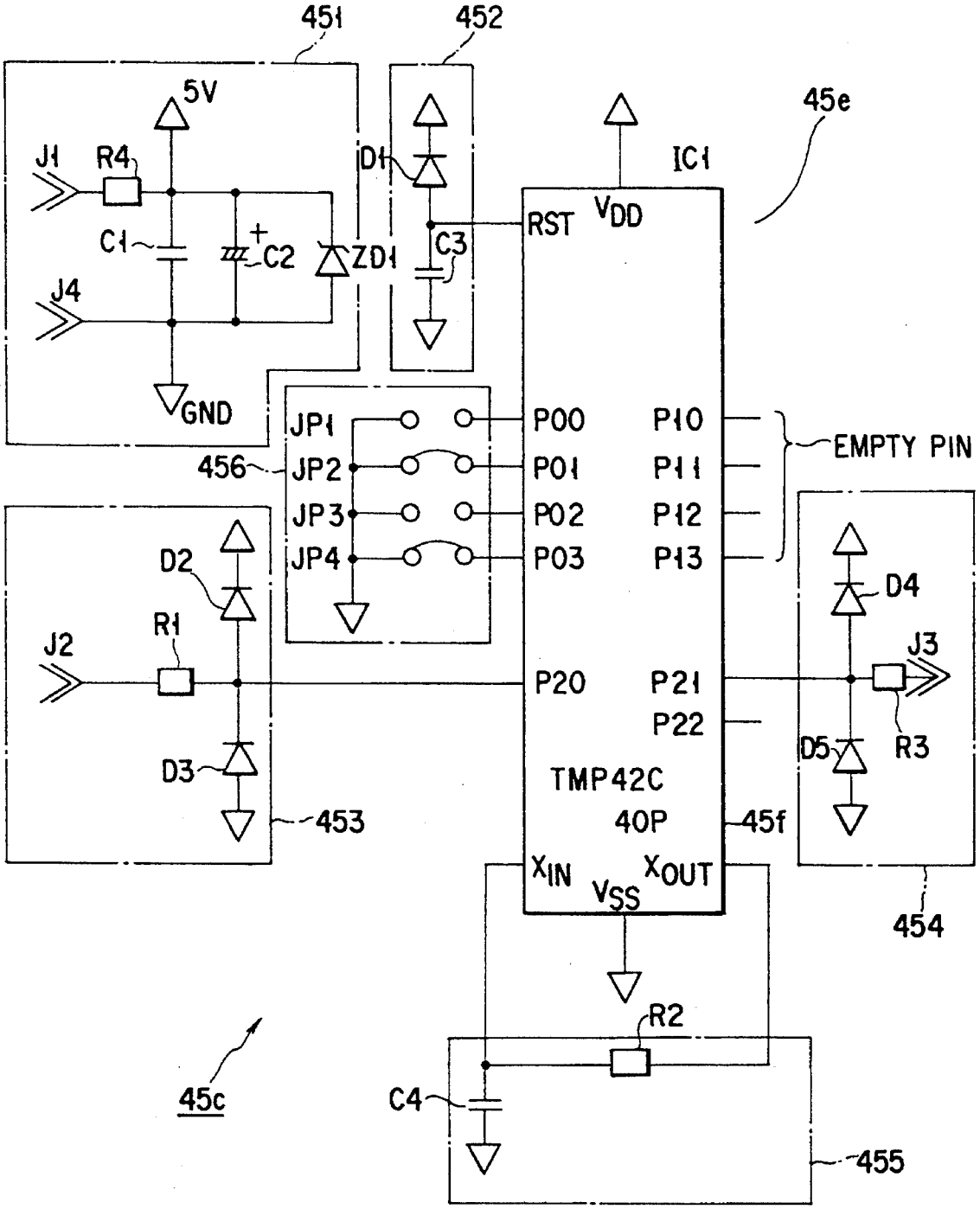
FIG. 6 is a block diagram showing the main part of the circuit configuration of the control PC board.

FIG. 6 shows the circuit configuration of the control PC board 45c described above.

A power supply voltage compensating circuit 451, a reset circuit 452, an input overvoltage protecting circuit 453, an output overvoltage protecting circuit 454, an oscillating circuit 455, a code generating circuit 456, and the like are formed on the control PC board 45c, in addition to the integrated circuit 45e.

As the integrated circuit 45e, for example, a 4-bit microcomputer TMP42C40P manufactured by Toshiba Corp., which belongs to the most inexpensive group as a cartridge CPU (IC1) 45f, is used.

This one-chip microcomputer is operated by the power supplied from the PPC 2 through the lead pins 45d.

The power supply voltage compensating circuit 451 stably supplies the operating supply voltage to the respective portions described above, and is constituted by, e.g., terminals J1 and J4 to be connected to two of the four lead pins 45d described above, a resistor R4, a Zener diode ZD1, and capacitors C1 and C2.

The resistor R4 and the Zener diode ZD1 are provided against a case wherein a ground (GND) voltage and the power supply voltage (5 V) are inserted in the opposite order or an overvoltage is applied. If only protection against opposite insertion is aimed at, a normal diode will do.

The reset circuit 452 sets the cartridge CPU 45f in the reset state and uses, in this embodiment, a CR simple reset circuit constituted by, e.g., a diode D1 and a capacitor C3 for decreasing the cost.

The overvoltage protecting circuit 453 protects the cartridge CPU 45f from the overvoltage applied to an input terminal (P20) of the cartridge CPU 45f, and is constituted by, e.g., a terminal J2 to be connected to one of the four lead pins 45d described above, a resistor R1, and diodes D2 and D3.

The overvoltage protecting circuit 454 protects the cartridge CPU 45f from the overvoltage applied to an output terminal (P21) of the cartridge CPU 45f, and is constituted by, e.g., a terminal J3 to be connected one of the four lead pins 45d described above, a resistor R3, and diodes D4 and D5.

The length of each of the four lead pins 45d connected to the control PC board 45c is designed to satisfy, e.g., "ground (GND)>+5 V>input/output pin".

Usually, the voltage is applied to the input and output terminals P20 and P21 after the power supply is turned on. IN this embodiment, the overvoltage protecting circuits 453 and 454 each having protection diodes and a protection resistor are provided. Hence, the cartridge CPU 45f is protected from being damaged even if an abnormality occurs, i.e., even if the voltage is applied to the input and output terminals P20 and P21 before the power supply is turned on.

The oscillating circuit 455 supplies an oscillation frequency output across $X_{IN}$ and $X_{OUT}$ terminals of the cartridge CPU 45f, and uses a CR simple oscillating circuit constituted by, e.g., a resistor R2 and a capacitor C4, in order to reduce the manufacturing cost.

The code generating circuit 456 designates a cartridge identification code (to be described later), and is constituted by jumper wires JP1 to JP4 to be connected to terminals P00 to P03 of the cartridge CPU 45f.

For example, in the 4-bit microcomputer TMP42C40P used in this embodiment, the software is permanent by a mask ROM during fabrication of the IC. Nonetheless, when the jumper wires JP1 to JP4 are changed, this microcomputer can identify a maximum of 16 types of toner cartridges.

Referring to FIG. 6, for example, "0AH" is designated as the cartridge identification code, the resistances of the resistors R1, R2, R3, and R4 are 22KΩ, 36KΩ, 1KΩ, and 10Ω, respectively, the capacitances of the capacitors C1, C2, C3, and C4 are 0.1 μF, 100 μF, 0.1 μF, and 100 pF, respectively, the voltages of the diodes D1 to D5 are 1S1588, V, and the voltage of the Zener diode ZD1 is 5.5 V.

The control PC board 45c also has, e.g., full or half duplex communicating means (not shown).

Figure 7:
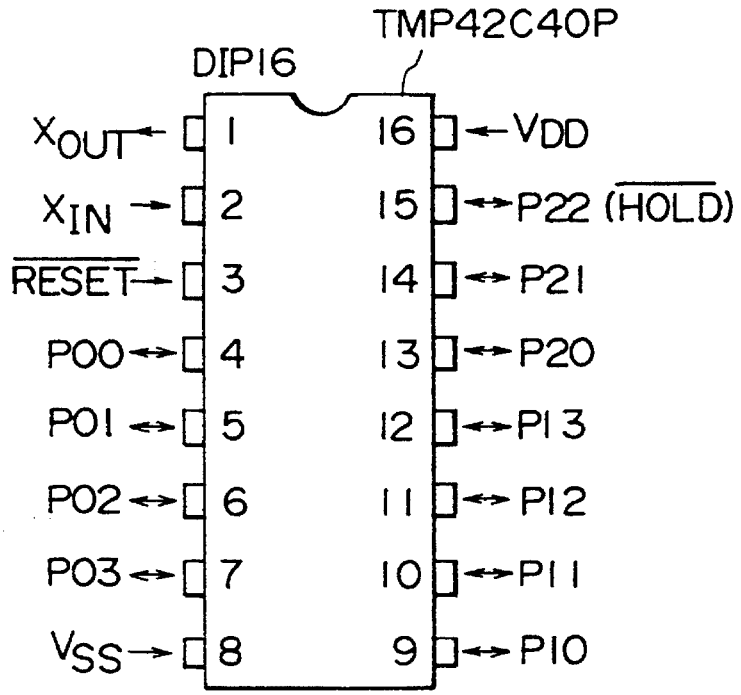
FIG. 7 is a view showing the outer appearance of the basic arrangement of a cartridge CPU.

FIG. 7 shows an arrangement of the pins of the 4-bit microcomputer TMP42C40P serving as the cartridge CPU 45f.

More specifically, of a total of 16 pins of the 4-bit microcomputer TMP42C40P, the first pin is the $X_{OUT}$ terminal, the second pin is the $X_{IN}$ terminal, the third pin is the reset terminal, the fourth pin is the terminal P00, the fifth pin is the terminal P01, the sixth pin is the terminal P02, the seventh pin is the terminal P03, the eighth pin is the $V_{SS}$ terminal, the ninth pin is a terminal P10, the tenth pin is a terminal P11, the eleventh pin is a terminal P12, the twelfth pin is a terminal P13, the thirteenth pin is an input terminal (P20), the fourteenth pin is an output terminal (P21), the fifteenth pin is a hold terminal (P22), and the sixteenth pin is the $V_{DD}$ terminal.

In this embodiment, the terminals P10, P11, P12, and P13 are empty pins.

Figure 8:
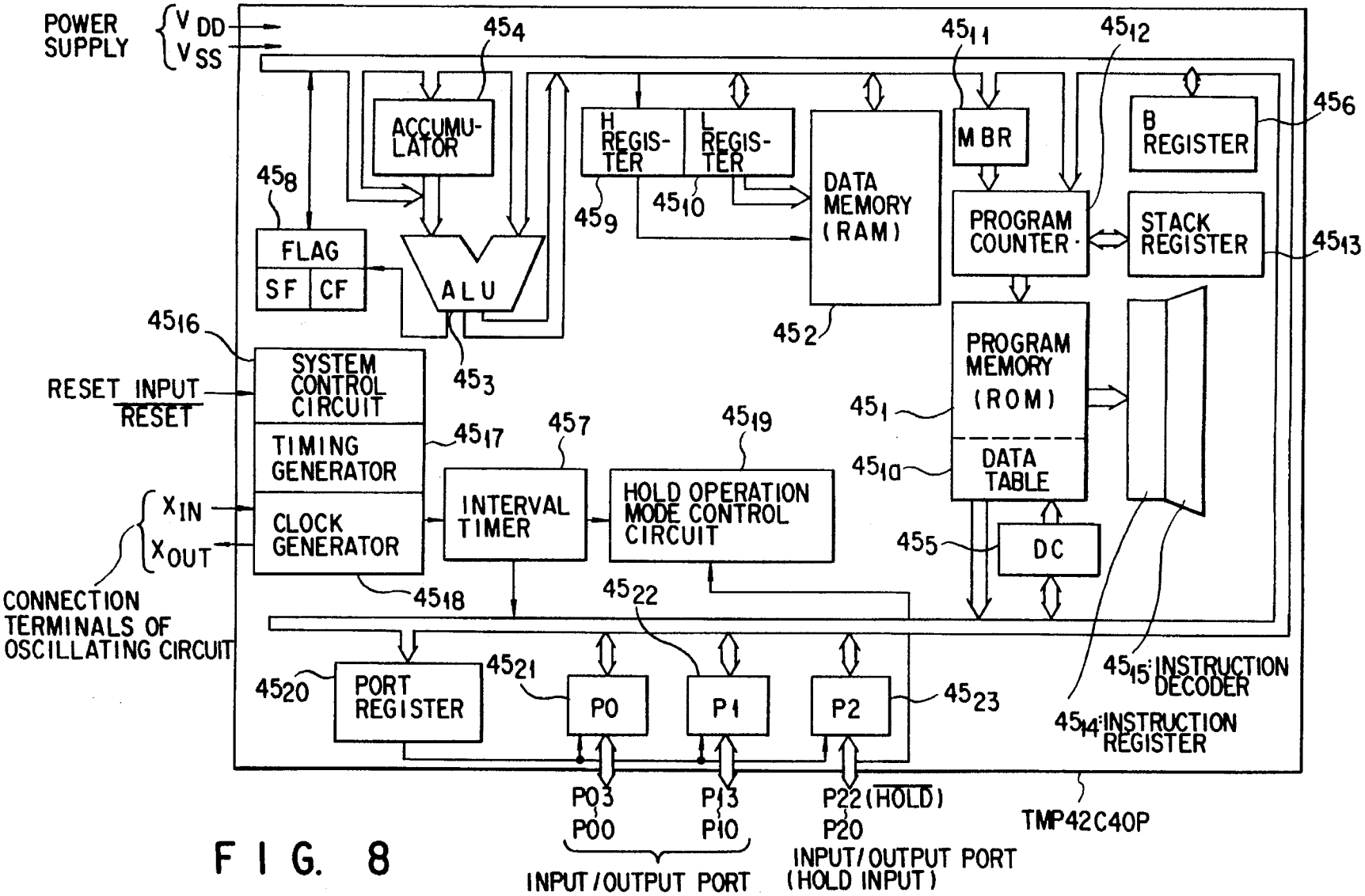
FIG. 8 is a block diagram showing the schematic arrangement of the cartridge CPU.

FIG. 8 is a block diagram of the function of the 4-bit microcomputer TMP42C40P.

More specifically, the 4-bit microcomputer TMP42C40P has a ROM $45_1$, a RAM $45_2$, a logic section (ALU) $45_3$, an accumulator $45_4$, a data counter (DC) $45_5$, a B register $45_6$, and an interval timer $45_7$. The ROM $45_1$ serves as a program memory storing a program. The RAM $45_2$ serves as a data memory for temporarily storing data. The ALU $45_3$ performs an arithmetic operation in accordance with the program in the ROM $45_1$. The accumulator $45_4$ serves as an A register for temporarily storing data in the ROM $45_1$. The DC $45_5$ is used to call data in the ROM $45_1$ to the A register $45_4$. The B register $45_6$ temporarily stores data used for arithmetic operations. The interval timer $45_7$ constantly outputs a waveform obtained by dividing the oscillation frequency into 2,048. The 4-bit microcomputer also has a flag register $45_8$, an H register $45_9$, an L register $45_{10}$, an MBR $45_{11}$, a program counter $45_{12}$, a stack register $45_{13}$, an instruction register $45_{14}$, an instruction decoder $45_{15}$, a system control circuit $45_{16}$, a timing generator $45_{17}$, a clock generator $45_{18}$, a hold operation mode control circuit $45_{19}$, a port register $45_{20}$, input/output ports (P0, P1, P2) $45_{21}$, $45_{22}$, and $45_{23}$, and the like.

The ROM $45_1$ has a data table $45_{1a}$ for storing ROM data necessary for encrypting transmission data (to be described later).

The interval timer $45_7$ inverts its output level (high level signal "H"/low level signal "L") about every 2 msec when the oscillation frequency of the oscillating circuit 455 is 500 kHz.

Figure 9:
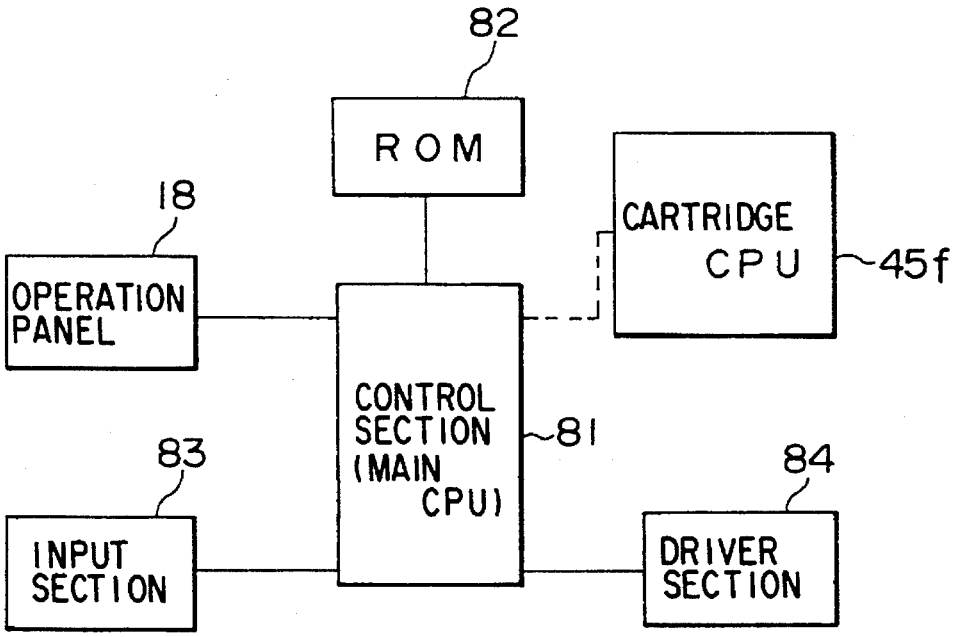
FIG. 9 is a block diagram showing the main part of the control circuit of the copying apparatus.

FIG. 9 shows the main part of the control circuit of the copying apparatus described above.

This control circuit are constituted by a control section 81, and the operation panel 18, a ROM 82, an input section 83, and a driver section 84 connected to the control section 81. The control section 81 serves as a main CPU for controlling the entire operation of the copying apparatus. The ROM 82 stores data (response to the command) for discriminating non-mounting and conformity/nonconformity of the toner cartridge 45, message data to be displayed on the LCD 18*e* of the operation panel 18, and the like. The input section 83 consists of sensors, e.g., the toner density sensor 44*h*, and a switch. The driver section 84 drives an optical system and driving systems, e.g., the photosensitive body 40 or a toner convey motor.

The control section 81 is connected to the cartridge CPU 45*f* when the predetermined toner cartridge 45 is mounted on the developing unit 44.

Figure 10:
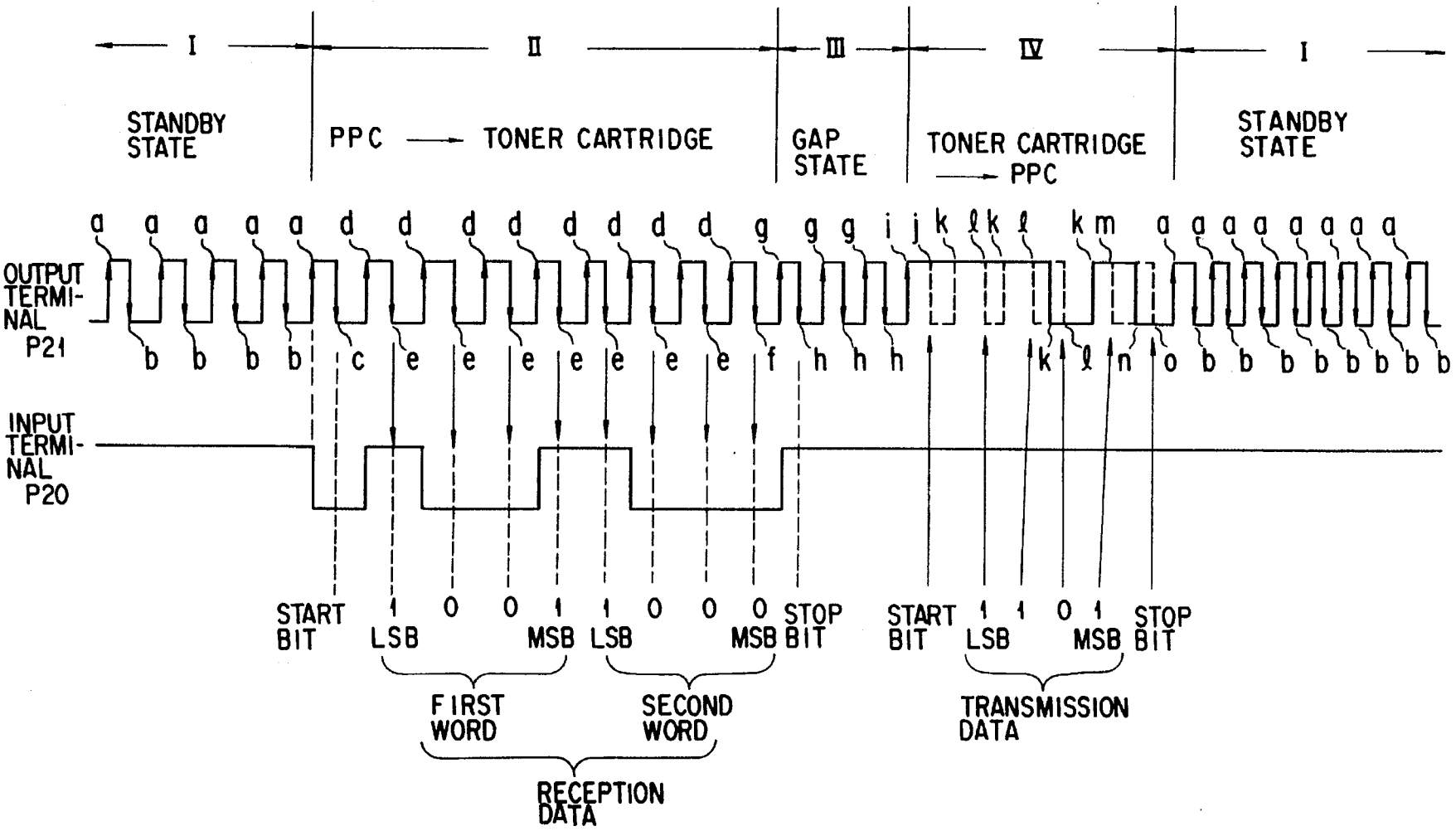
FIG. 10 is a waveform chart showing signals appearing at the input and output terminals of the cartridge CPU shown in FIG. 7.

FIG. 10 shows waveforms appearing at the input and output terminals P20 and P21 of the cartridge CPU 45*f*.

Serial communication performed between the PPC 2 and the toner cartridge 45 will be briefly explained.

Normally (in standby state), the control section 81 of the PPC 2 outputs a high level signal "H" to maintain the input terminal P20 of the cartridge CPU 45*f* at high level. During this period of time, a pulse signal (rectangular wave) having a frequency of about 4 msec is sequentially output from the cartridge CPU 45*f* to the PPC 2 through the output terminal P21.

This is because the 4-bit microcomputer TMP42C40P of this embodiment is operated at the oscillation frequency of 500 kHz and at this time the interval timer $45_7$ inverts the H/L level state of the output every 2 msec.

The frequency of the pulse signal from the cartridge CPU 45*f* during this standby period is measured so that this pulse signal is used as an internal frequency (sync frequency) signal for data transmission by the PPC 2.

As described above, the cartridge CPU 45*f* obtains a master clock by CR oscillation. For this reason, the interval frequency of the cartridge CPU 45*f* largely varies depending on the power supply voltage, the variations in elements, the temperature, and the like. Hence, the frequency of the pulse is measured during the standby period in order to correct this variation in the master clock and to correctly perform communication.

When the control section 81 starts communication, it outputs an L-level 1-bit start bit, an H-level 1-bit stop bit, and 8-bit data as a request signal in synchronism with the leading edge (timing a) of the pulse supplied from the output terminal P21 of the cartridge CPU 45*f*.

In this case, the control section 81 generates interruption in response to the leading edge of the output from the output terminal P21 of the cartridge CPU 45*f*. In this interrupt routine, the start bit (1 bit), the reception data (8 bits), and the stop bit (1 bit) described above are output to the cartridge CPU 45*f* (UART communication of the clock frequency).

When the input terminal P20 of the cartridge CPU 45*f* is set at L level by the start bit from the control section 81, the cartridge CPU 45*f* sequentially receives reception data in synchronism with the trailing edges (timings e and f) of the pulses appearing at the output terminal P21.

When output of the data from the control section 81 is completed, the input terminal P20 of the cartridge CPU 45*f* is kept at H level by the stop bit following the start bit. The control section 81 is kept in the standby state until the output from the output terminal P21 of the cartridge CPU 45*f* is set at H level for 0.75 cycle or more of the frequency sampled during the standby period (the start bit from the cartridge CPU 45*f* is waited).

When data transmission from the control section 81 is completed, the cartridge CPU 45*f* stores, of the 8-bit reception data, the first 4 bits and the second 4 bits as the first word (command) and the second word in its RAM $45_2$.

Then, the cartridge CPU 45*f* generates 4-bit response transmission data (response signal) based on the program in the ROM $45_1$ in accordance with the encrypting method (rule) designated by the first word by using, e.g., the argument of the second word and the cartridge identification code designated by the jumper wires JP1 to JP4 of the code generating circuit 456.

When the generation of the transmission data is completed, the cartridge CPU 45*f* outputs an H-level 1-bit start bit and an H-level 1-bit stop bit from the output terminal P21 in synchronism with the output from the internal interval timer $45_7$.

In some cases, transmission data is not sent to the PPC 2 depending on the type of command (first word) (to be described later) from the control section 81.

When the start bit is output from the cartridge CPU 45*f*, the control section 81 sequentially receives the transmission data from the cartridge CPU 45*f* based on the sync frequency measured in advance during the standby period (clock asynchronous UART).

It is determined whether or not the received transmission data is a response following the rule designated to the cartridge CPU 45*f*, i.e., whether or not the received transmission data is a correct response to the command, thereby discriminating non-mounting and conformity/nonconformity of the toner cartridge 45.

For example, in this embodiment, the identification data in units of rules of the cartridge identification codes and ROM data of the toner cartridge 45 that should originally be mounted are read out from the ROM 82 and compared with the transmission data. The conformability of the toner cartridge 45 is determined in accordance with whether or not the identification data coincides with the transmission data.

In this manner, the control operation (permission/prohibition) of the toner replenishing operation described above and the display control operation (to be described later) to the user are performed in accordance with the reception state of the transmission data or the content of the received transmission data.

Figure 11:
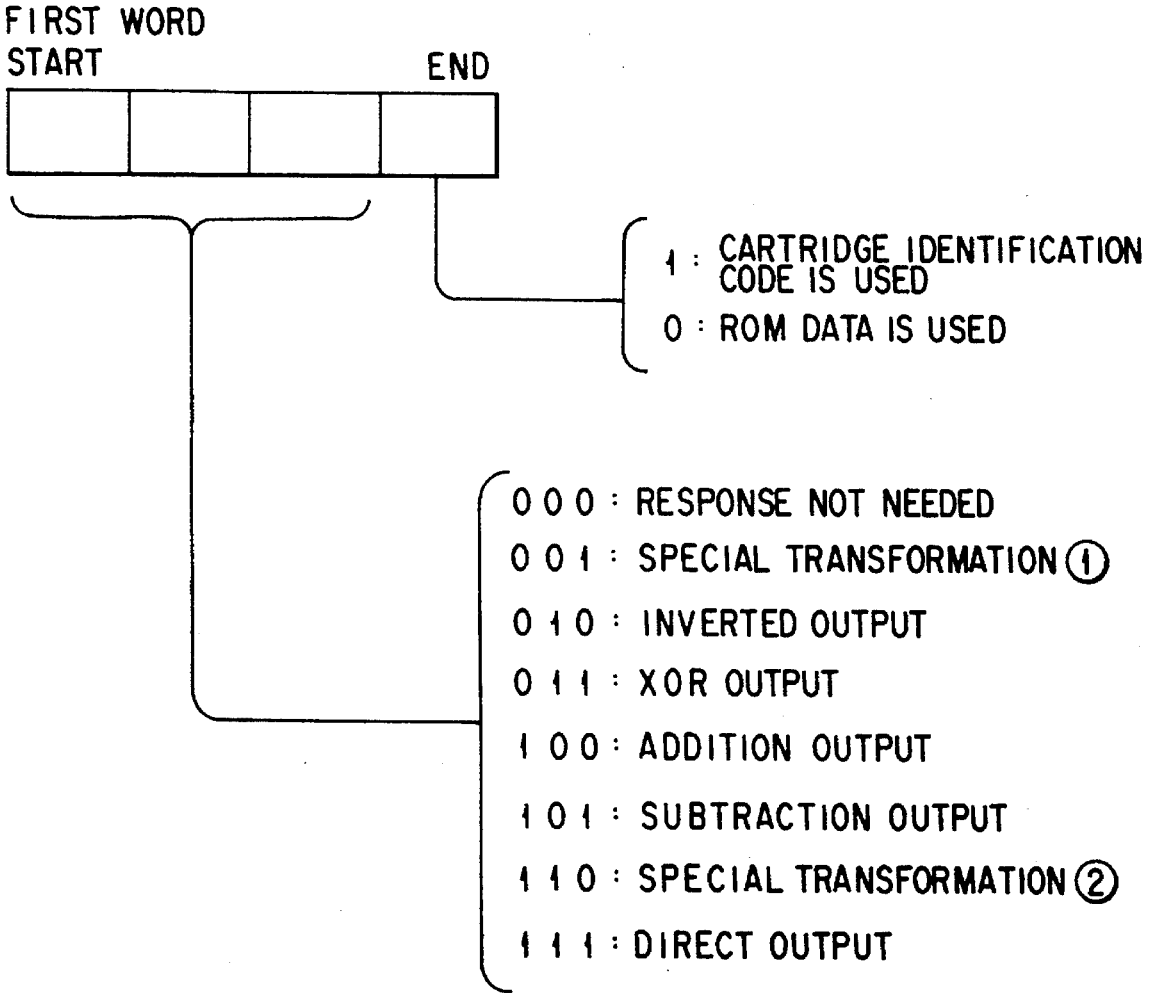
FIG. 11 is a view showing the data format of the first word of the data output from the control section of the copying apparatus.

FIG. 11 shows the data format of the first word of the reception data described above.

The first word of the reception data consists of, e.g., 4 bits, the upper 3 bits of which are the information indicating the encrypting method (rule) and the last 1 bit is the data used for encrypting, i.e., the last 1 is the information indicating whether the password is formed by using the cartridge identification code or the ROM data.

This first word command can be changed as required depending on the operating state of the PPC 2, i.e., the number of operating times of the main switch, the total copy count, the color of the toner T, and data in a nonvolatile memory (not shown) provided in the PPC 2 that can be rewritten by the operation panel 18 or a DIP switch.

The operation of the cartridge CPU 45*f* will be described in detail.

Figure 12A:
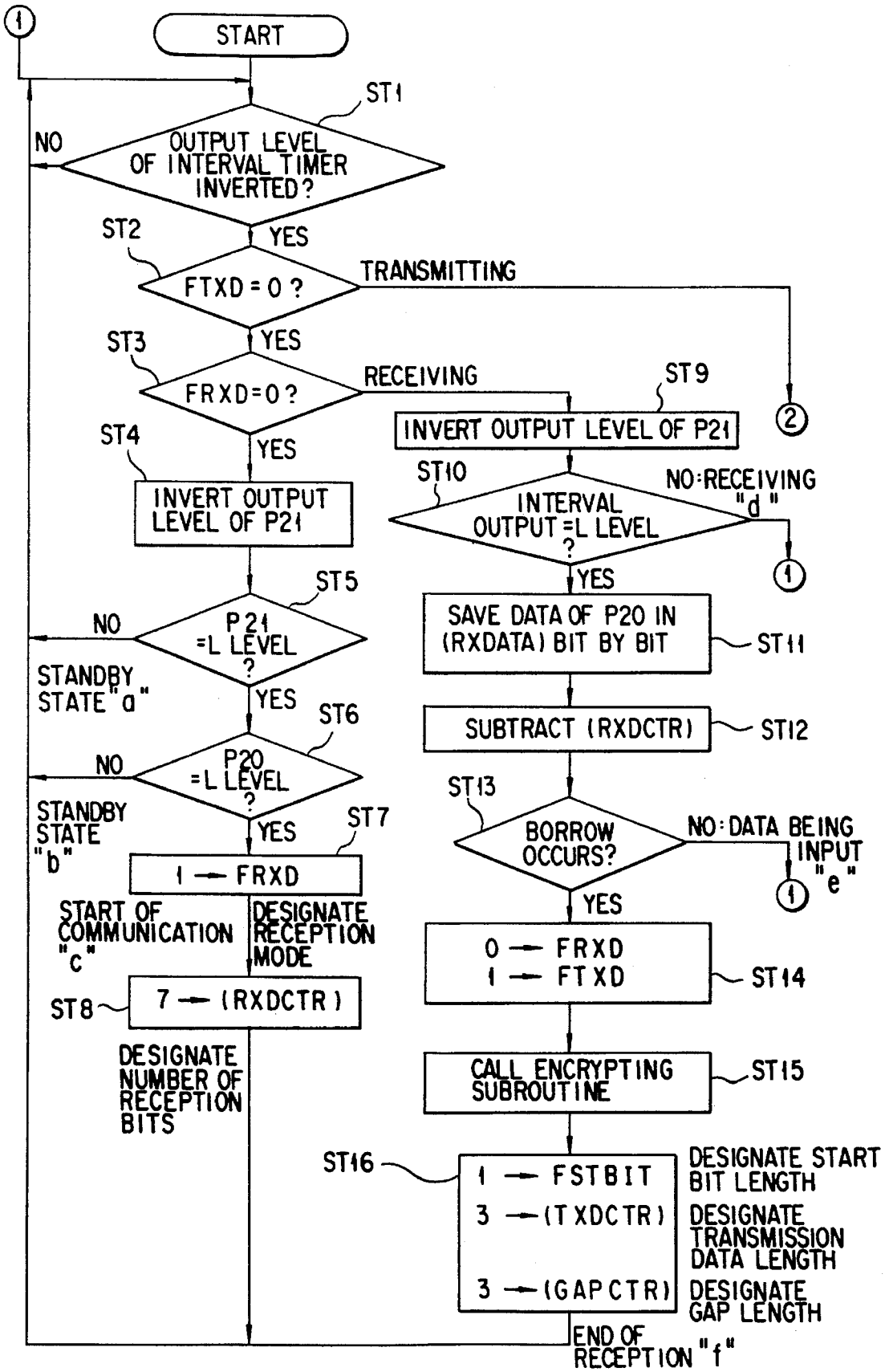
FIGS. 12A and 12B are flow charts for explaining the flow of the processing operations for communication control of the cartridge CPU.
Figure 12B:
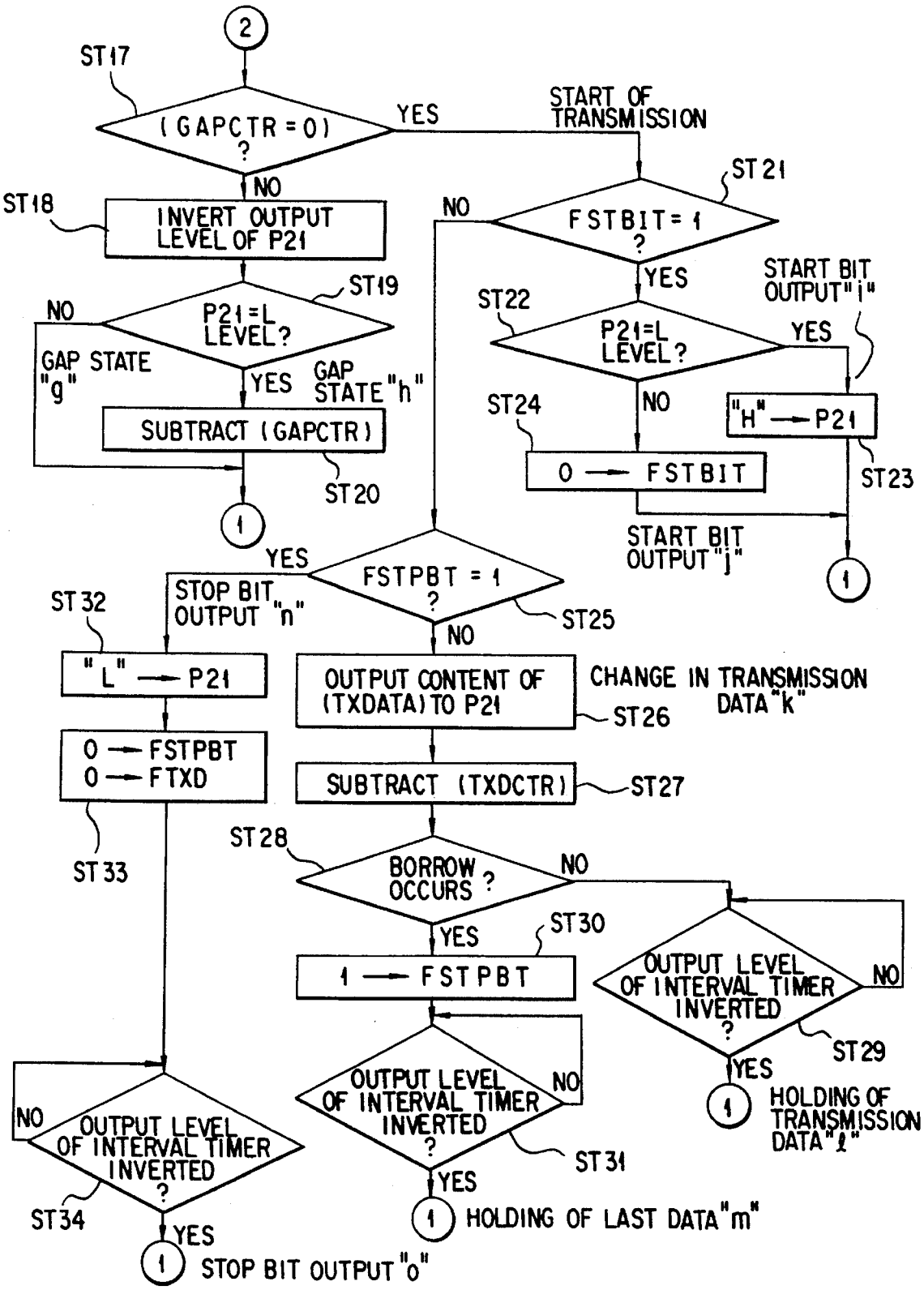

FIGS. 12A and 12B show the flow of the processing operations for communication control of the cartridge CPU 45*f* described above.

First, whether or not the level (high level "H"/Low level "L") of the output from the interval timer $45_7$ is inverted is constantly monitored (step ST1).

When a change in output level is confirmed, the states of the transmission mode designation flag (FTXD) and the reception mode designation flag (FRXD) assigned as areas on the RAM $45_2$ are checked (steps ST2 and ST3).

Since the flags (FTXD and FRXD) indicating the transmission and reception operating states are cleared to "0" in the initial stage, the flow advances to step ST4, and the level of the output terminal P21 is inverted.

When the output from the output terminal P21 is set at "H" level by this inversion (corresponding to timing a in FIG. 10), the flow advances to step ST1, and inversion of the output from the interval timer $45_7$ is waited for again (step ST8).

In this state, when about 2 msec have elapsed, the output level of the output terminal P21 is inverted in accordance with the same procedures as described above (step ST4), and at this time the output from the output terminal P21 is set at "L" level (corresponding to timing b in FIG. 10).

When the output from the output terminal P21 is set at "L" level, the flow advances to step ST6, and the level of the input terminal P20 is checked.

In this case, since the control section 81 of the PPC 2 initially maintains the input terminal P20 at "H" level, the flow advances to step ST1.

In this manner, when the processing operations of steps ST1 to ST6 are repeated, state I (standby state) of FIG. 10 is realized.

When the control section 81 requests a start of communication, the input terminal P20 becomes "L" level. In the cartridge CPU 45*f*, the flow advances to step ST7 through step ST6.

In step ST7, "1" indicating receiving is set in the reception mode designation flag (FRXD), and in the next step ST8, the number of received bits are set in a reception counter (RXDCTR) assigned to the RAM $45_2$ (corresponding to timing c in FIG. 10).

The reception counter (RXDCTR) is an area on the RAM $45_2$ corresponding to 1-word (4-bit) data and is used for counting the number of received input data. In this case, "7" is set as the number of received bits. Every time data is input, the count of the reception counter is decremented by one to manage the remaining number of received bits. When a borrow occurs, an end of reception is informed to the user.

Thereafter, when about 2 msec have elapsed, the flow advances to step ST9 through the processing operations (steps ST1, ST2, and ST3) described above, and the level of the output terminal P21 is inverted.

In step ST10, whether or not the output from the interval timer $45_7$ is at "L" level is checked. At this time, since the output from the output terminal P21 is set at "H" level by the processing operation by step ST9, the flow temporarily advances to step ST1 (corresponding to timing d in FIG. 10).

When about 2 msec have elapsed, the flow advances to steps ST9 and ST10 again through the processing operations (steps ST1, ST2, and ST3) described above.

At this time, since the output terminal P21 is set at "L" level by the processing operation in step ST9, a predetermined processing operation is performed in step ST11. More specifically, data is input from the input terminal P20, and the content of a reception register (RXDATA) assigned as an area on the RAM $45_2$ is changed bit by bit.

The reception register (RXDATA) is an area on the RAM $45_2$ corresponding to 2 words (4 bits×2) and used for storing the received input data. Which bit is to be changed depends on the count of the reception counter (RXDCTR).

The detailed description of this processing operation will be omitted.

When storage of data to the reception register (RXDATA) is executed in this manner, the count of the reception counter (RXDCTR) is decremented by one in order to indicate that 1-bit data input is completed step ST12).

At this time, the count of the reception counter RXDCTR) is set at "6". Since no borrow occurs in this case (step ST13), the flow advances to step ST1 (corresponding to timing e of FIG. 10).

Thereafter, every time about 2 msec elapse, the respective processing operations (steps ST1, ST2, ST3, ST9, ST10, ST11, ST12, and ST13) are repeated in the same manner. In each time, data from the control section 81 is stored in the reception register (RXDATA), and the count of the reception counter (RXDCTR) is decremented by one.

When the processing operations of steps ST11 and ST12 are executed eight times, a borrow is generated (step ST13), the reception mode designation flag (FRXD) is set at "0" indicating reception completion, and "1" is set in the transmission mode designation flag (FTXD) to enable the start of transmission so that transmission can be started immediately (step ST14).

When the processing operations of steps ST11 and ST12 are repeated in this manner, state II of FIG. 10 is realized.

In normal asynchronous communication, generally a control operation of checking the stop bit intervenes after step ST14. However, the description of this control operation is omitted here for the sake of simplicity.

When the processing operation in step ST14 is completed, transmission data is generated (encrypted) based on the data stored in the reception register (RXDATA) in the RAM $45_2$ which is sent from the control section 81 (step ST15).

The processing operation of generating the transmission data will be described later.

When generation of the transmission data is completed, "1" as a request for setting a start bit is set in a start bit setting flag (FSTBIT) assigned in the RAM $45_2$ in step ST16. A transmission counter (TXDCTR) assigned in the RAM $45_2$ is set to control the number of transmission data, and a gap counter (GAPCTR) assigned in the RAM $45_2$ is set to control the gap between reception and transmission (corresponding to timing f in FIG. 10).

The transmission counter (TXDCTR) is an area in the RAM $45_2$ corresponding to 1-word (4-bit) data, and is used for counting the number of remaining bits of data that needs to be transmitted. In this case, "3" is set as the number of transmission data. Every time data is output, the transmission counter (TXDCTR) is decremented by one to manage the number of remaining transmission data. When a borrow occurs, the end of transmission is informed to the user.

The gap counter (GAPCTR) is an area in the RAM $45_2$ corresponding to 1-word (4-bit) data, and is used for reserving a gap time between transmission and reception. In this case, when last data is received during reception, "3" is set in the gap counter, and thereafter the gap counter outputs "H" and "L" pulses three times each.

While the cartridge CPU 45*f* sets the gap time, the control section 81 of the PPC 2 transmits a stop bit, and the communication mode is changed from the output mode to the input mode.

Thereafter, when about 2 msec have elapsed, the flow advances to step ST17 through the respective processing operations (steps ST1 and ST2) described above to check whether or not the count of the gap counter (GAPCTR) is "0".

If the count is not "0", the level of the output terminal P21 is inverted (step ST18).

Then, the level of the output terminal P21 is checked (step ST19). When the output terminal P21 is not at "L" level, the flow advances to step ST1 (corresponding to timing g in FIG. 10).

On the other hand, when the output terminal P21 is at "L" level, the count of the gap counter (GAPCTR) is decremented by one in step ST20 (corresponding to timing h in FIG. 10), and the flow advances to step ST1.

In this manner, when the processing operations of the steps ST1, ST2, ST17, ST18, and ST19; or the steps ST1, ST2, ST17, ST18, ST19, and ST20 are repeated three times until the count of the gap counter (GAPCTR) becomes "0", state III of FIG. 10 is realized.

In the processing operation of step ST20, when the count of the gap counter (GAPCTR) becomes "0", the flow advances to step ST21 through step ST17, and the state of a start bit setting flap (FSTBIT) is checked.

In this case, since "1" is set in the start bit setting flag (FSTBIT) by the processing operation in step ST16, the flow advances to step ST22.

In step ST22, the level of the output terminal P21 is checked. When it is at "L" level, the output terminal P21 is changed to "H" level in step ST23 (corresponding to timing i in FIG. 10), and the flow advances to step ST1.

Thereafter, when about 2 msec have elapsed, the flow advances to step ST24 through the respective processing operations (steps ST1, ST2, ST17, ST21, and ST22) described above.

More specifically, when the output terminal P21 is maintained at "H" level, an "H" level 1-bit start bit is generated, and a start bit setting flag (FSTBIT) is reset to "0" simultaneously (corresponding to timing j in FIG. 10).

Thereafter, when about 2 msec have elapsed, the flow advances to step ST25 through the respective processing operations (steps ST1, ST2, ST17, and ST21) described above.

More specifically, when it is determined that the start bit setting flag (FSTBIT) is "0" in step ST21, the state of a stop bit setting flag (FSTPBT) assigned in the RAM $45_2$ is checked in step ST25.

In this case, since the stop bit setting flag (FSTPBT) is initially set at "0", the flow advances to step ST26, and the 1-bit content of a transmission register (TXDATA) is output to the output terminal P21.

The transmission register (TXDATA) is an area in the RAM $45_2$ corresponding to 1-word (4-bit) data, and is used for storing transmission data generated by the processing operation (encrypting subroutine to be described later) in step ST15 described above.

More specifically, the processing operation in step ST26 is a control operation for determining which bit data of the transmission register (TXDATA) is to be output in accordance with the count of the transmission counter (TXDCTR) and for actually outputting the determined bit data from the output terminal P21 (corresponding to timing k in FIG. 10).

The detailed description of this processing operation will be omitted.

The count of the transmission counter (TXDCTR) is decremented by one (step ST27).

At this time, the count of the transmission counter (TXDCTR) is set at "2". In this case, since no borrow occurs (step ST28), the flow advances to step ST29.

After a delay of about 2 msec is effected, the flow advances to step ST1, and the respective processing operations (steps ST1, ST2, ST17, ST21, ST25, ST26, ST27, ST28, and ST29) described above are repeated (corresponding to a timing l in FIG. 10).

As a result, since a delay of about 2 msec is effected by the processing operation of each of the steps ST29 and ST1, the processing operation of step ST26 is executed once about every 4 msec.

When the processing operation of step ST26 is repeated four times, the count of the transmission counter (TXDCTR) is set at "0" (step ST27), and a borrow occurs (step ST28).

Then, the flow advances to step ST30, and "1" as a request for setting a stop bit is set in the stop bit setting flag (FSTPBT) assigned in the RAM $45_2$.

Thereafter, when about 2 msec have elapsed (step ST31), a last data hold timing is obtained (corresponding to timing m in FIG. 10).

Then, the flow advances to step ST1, and to step ST32 through the respective processing operations (steps ST1, ST2, ST17, ST21, and ST25).

At this time, since "1" is set in the stop bit setting flag (FSTPBT) by the processing operation of previous step ST30, the output terminal P21 is changed to "L" level in step ST32.

More specifically, when the output terminal P21 is changed to "L" level, a 1-bit stop bit ("H" level") is generated (corresponding to a timing n in FIG. 10), and simultaneously both the stop bit setting flag (FSTPBT) and the transmission mode designation flag (FTXD) are reset to "0" (step ST33).

Thereafter, when about 2 msec have elapsed (step ST34), a stop bit output timing is obtained (corresponding to timing o in FIG. 10).

In this manner, when the stop bit is transmitted, transmission of the transmission data is completed, and a state IV of FIG. 10 is realized.

After transmission is completed, the flow advances to step ST1, and a standby mode I of FIG. 10 wherein a rectangular wave having a period of about 4 msec is continued to be transmitted at the timings a and b is restored.

The flow of the processing operations (software) for realizing the waveforms appearing at the input and output terminals P20 and P21 of the cartridge CPU 45*f* has been described above.

Figure 13:
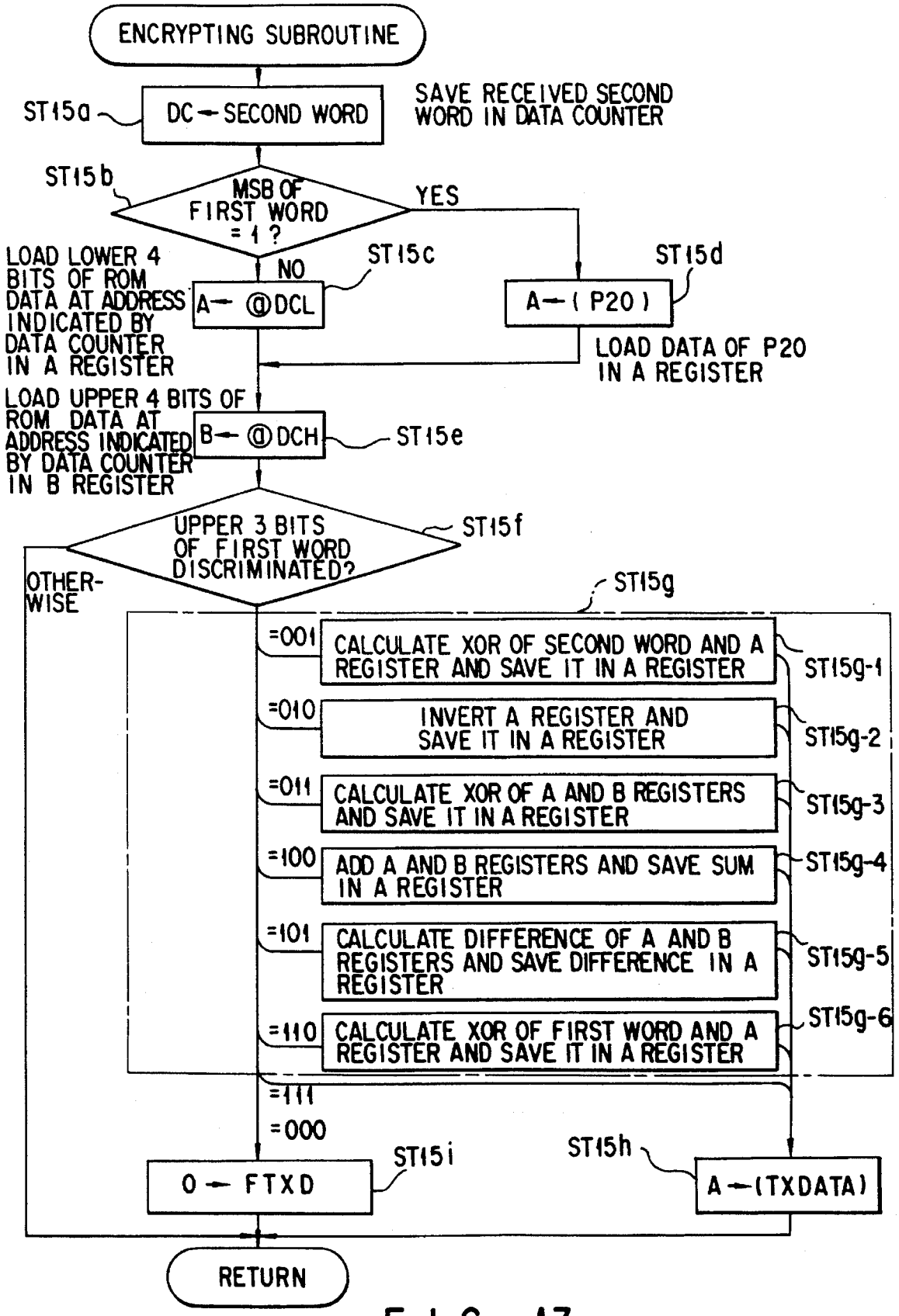
FIG. 13 is a flow chart for explaining the flow of the processing for generation of transmission data in the cartridge CPU.

FIG. 13 shows the flow of the encrypting operations (step ST15) concerning generation of the transmission data described above.

First, data corresponding to the second word of the reception data stored in the reception register (RXDATA) is set in the data counter (DC) $45_5$ of the cartridge CPU 45*f* (step ST15*a*).

Thereafter, whether or not the first bit (fourth data counted from the start bit (the MSB of the first word)) of data corresponding to the first word of the reception data stored in the reception register (RXDATA) is "1" is checked (step ST15*b*).

If the MSB of the first word is not "1", for example, the lower 4 bits of the ROM data (8 bits) corresponding to the address on the data table $45_{1a}$ provided in the ROM $45_1$ are loaded in the A register (accumulator) $45_4$ (step ST15*c*).

On the other hand, if the MSB of the first word is "1", the data (4 bits) at the input terminal P20 is loaded in the A register $45_4$ (step ST15*d*).

In this embodiment (the reception data shown in FIG. 10), since the MSB of the first word is "1", the processing operation of step ST15*d* is executed. More specifically, when the code generating circuit 456 is in the state shown in FIG. 6, the terminals P01 and P03 of the cartridge CPU 45*f* corresponding to the jumper wires JP2 and JP4 become "L" level, and the terminals P00 and P02 thereof corresponding to the jumper wires JP1 and JP3 become "H" level. As a result, "1010 (0AH)" is loaded in the A register $45_4$.

Thereafter, the upper 4 bits of the ROM data (8 bits) indicated by the count of the data counter (DC) $45_5$ and corresponding to the address in the data table $45_{1a}$ provided in the ROM $45_1$ are loaded in the B register $45_6$ (step ST15*e*).

Then, the upper 3 bits of data corresponding to the first word of the reception data stored in the reception register (RXDATA) are checked (step ST15*f*), and the processing operation of subsequent step ST15*g* is determined in accordance with this result.

For example, if the upper 3 bits of the first word are "001", the processing operation of step ST15*g*-1, of step ST15*g*, is executed, i.e., the XOR of the second word of the reception data and the value in the A register $45_4$ is obtained, and the result is saved in the A register $45_4$ (processing operation corresponding to the encrypting rule of command "001 (special transformation ①)" in FIG. 11).

If the upper 3 bits of the first word are "010", the processing operation of step ST15*g*-2 is executed, i.e., the value of the A register $45_4$ is inverted, and the result is saved in the A register $45_4$ (processing operation corresponding to the encrypting rule of command "010 (inverted output)" of FIG. 11).

If the upper 3 bits of the first word are "011", the processing operation of step ST15*g*-3 is executed, i.e., the XOR of the values of the A and B registers $45_4$ and $45_6$ is obtained, and the result is saved in the A register $45_4$ (processing operation corresponding to the encrypting rule of command "011 (XOR output)" of FIG. 11).

If the upper 3 bits of the first word are "100", the processing operation of step ST15*g*-4 is executed, i.e., the sum of the values of the A and B registers $45_4$ and $45_6$ is obtained, and the result is saved in the A register $45_4$ (processing operation corresponding to the encrypting rule of command "100 (addition output)" of FIG. 11).

If the upper 3 bits of the first word are "101", the processing operation of step ST15*g*-5 is executed, i.e., the difference between the values of the A and B registers $45_4$ and $45_6$ is obtained, and the result is saved in the A register $45_4$ (processing operation corresponding to the encrypting rule of command "101 (subtraction output )" of FIG. 11).

If the upper 3 bits of the first word are "110", the processing operation of step ST15*g*-6 is executed, i.e., the XOR of the first word and the value of the A register $45_4$ is obtained, and the result is saved in the A register $45_4$ (processing operation corresponding to the encrypting rule of command "110 (special transformation ②)) of FIG. 11).

For example, in this embodiment, since the upper 3 bits of the first word of the data in the reception register (RXDATA) are "1001 (09H)", its upper 3 bits are "100", the sum of the value "1010" of the A register $45_4$ and the value (xxxx) of the B register $45_6$ is obtained in step ST15*g*-4 accordingly, and the result is saved in the A register $45_4$.

In this manner, the arithmetic operation result saved in the A register $45_4$ is set in the transmission register (TXDATA) (step ST15*h*) and becomes the transmission data (response signal) described above.

If the upper 3 bits of the first word are "111", the value of the A register $45_4$ is directly set in the transmission register (TXDATA) in step ST15*h* (processing operation corresponding to the encrypting rule of command "111 (direct output)" of FIG. 11).

If all of the upper 3 bits of the first word are all "0"s, the content of the transmission designation flag (FTXD) is reset to "0" (step ST15*i*). In this case, the processing operation is discontinued without performing transmission (corresponding to the encrypting rule of command "000 (response not needed)" of FIG. 11).

In this manner, various types of arithmetic operations are selectively executed in accordance with the values of the upper 3 bits of the first word, and the encrypting processing operation (encrypting subroutine) for obtaining transmission data is ended.

If the upper 3 bits of the first word correspond to none of the commands described above, the encrypting processing operation for obtaining transmission data is not performed, and the routine is ended.

The operation of the arrangement described above will be described.

Figure 14:
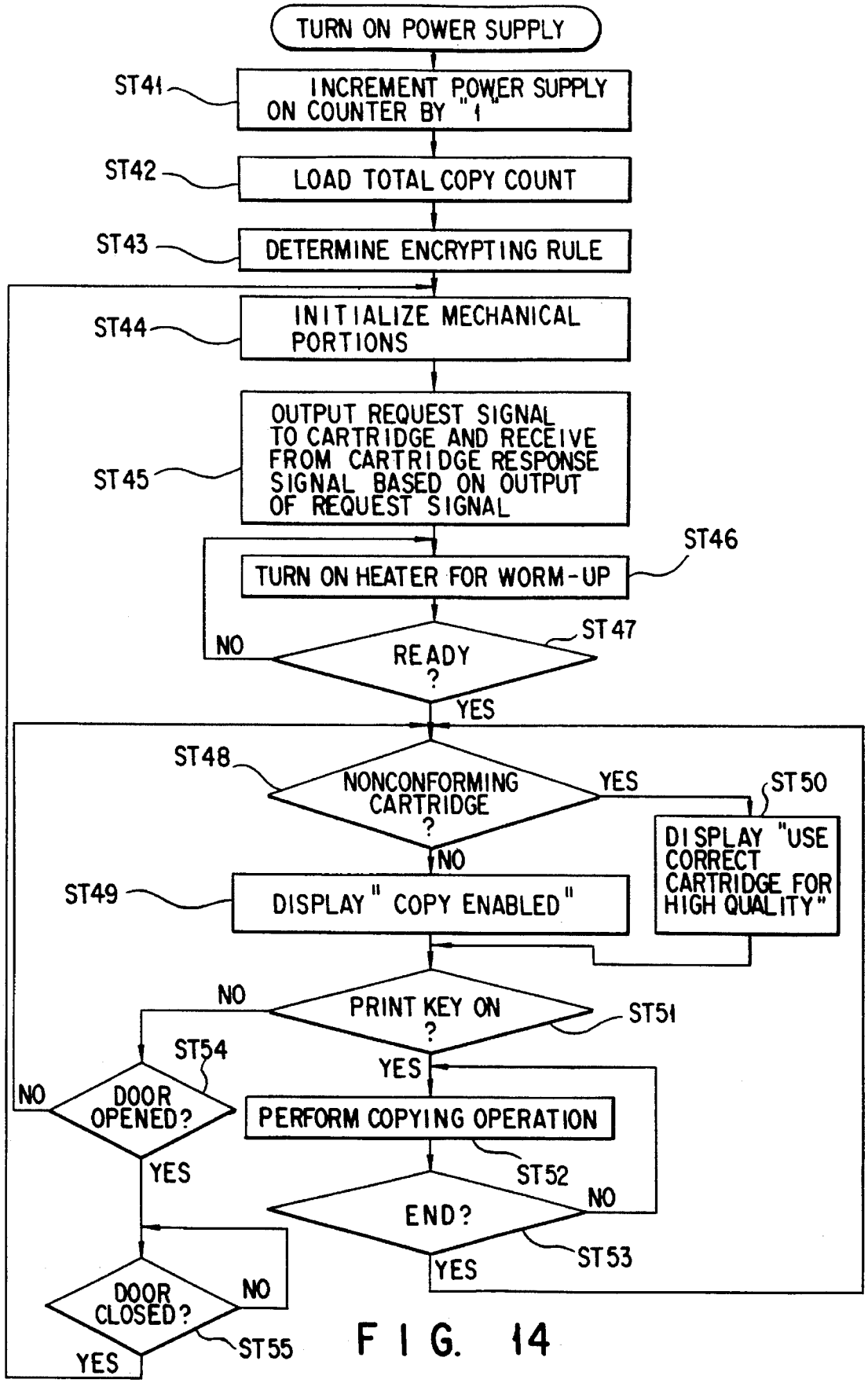
FIG. 14 is a flow chart for schematically explaining the flow of the processing for the identification operation of the toner cartridge.

FIG. 14 schematically shows the flow of the processing for the identification operation of the toner cartridge 45.

Assume that the power switch serving as the main switch is turned on, or that the front cover of the PPC 2 is opened and closed to perform jamming processing or to exchange the toner cartridge 45.

Then, the count (8-bit data) of a power supply ON counter assigned on the memory in the control section 81 is incremented by one (step ST41), and data (16-bit data) from a non-volatile memory (not shown) for managing the total copy count is loaded in the control section 81 (step ST42).

The encrypting rule (the type of command) in the encrypting subroutine (described above) is determined on the basis of these data (step ST43).

Thereafter, the mechanical portions of the PPC 2 are initialized (step ST44), and communication described above between the cartridge CPU 45*f* and the control section 81 is performed (step ST45).

More specifically, the control section 81 of the PPC 2 transmits, as a request signal, data (corresponding to the reception data of FIG. 10) including a command (first word)) which is changed as required in accordance with, e.g., the number of operating times of the main switch or the total copy count.

In response to the data transmitted from the control section 81, the cartridge CPU 45*f* that has received this data analyzes the command of the received data. Transmission data (response signal) to be sent back to the control section 81 is generated by performing encrypting in accordance with this command. The generated transmission data is sent back to the control section 81 in accordance with its command.

For example, assume that the control section 81 transmits reception data "01110011" to the toner cartridge 45 in which "0110 (cartridge identification code)" is set by the jumper wires JP1 to JP4 of the code generating circuit 456. In this case, an XOR output "0101" of "0011" of the second word and the identification code is generated as the transmission data in accordance with the rule of command "011" of the first word of the reception data. The generated transmission data "0101" is sent back from the cartridge CPU 45*f* to the control section 81.

In contrast to this, assume that the control section 81 transmits, e.g., reception data "000***** (* is 1 or 0)" to the cartridge CPU 45*f*. In this case, no transmission data is sent back from the cartridge CPU 45*f* to the control section 81 in accordance with the rule of command "000" of the first word, i.e., response not needed.

Normally, when the heat roller 58*a* serving as the heater is warmed up (step ST46) to reach a temperature necessary for fixing, the PPC 2 is set in the ready (copy enabled) state (step ST47). Then, a predetermined message is read out from the ROM 82, and "Copy enabled." is displayed on the LCD 18*e* of the operation panel 18 (step ST49).

In this PPC 2, if the preset toner cartridge 45 is determined to be nonconforming through communication between the toner cartridge 45 and the control section 81 (step ST48), an alarm message is read out from the ROM 82, and, e.g., "Use a correct cartridge for a high quality" is displayed on the LCD 18*e* of the operation panel 18 (step ST50).

More specifically, upon reception of the transmission data from the cartridge CPU 45*f*, the control section 81 reads out, e.g., determination data in the ROM 82 having as the address the command transmitted to the cartridge CPU 45*f*, and discrimination of conformity/nonconformity of the toner cartridge 45 is performed in accordance with the reference result of the identification data and the transmission data.

For example, if data "01110011" is transmitted from the control section 81 to the cartridge CPU 45*f* and transmission data "0101" is not received by the control section 81 from the cartridge CPU 45*f*, it is determined that a toner cartridge 45 not conforming to the PPC 2 is mounted.

When a toner cartridge 45 does not conform to the rule, i.e., when the nonconformity of the toner cartridge 45 is identified, the alarm message described above is displayed. In this manner, when the mounted toner cartridge 45 is a cartridge other than the one having a performance guaranteed by the manufacturer of the PPC 2, an alarm is generated not to use this cartridge.

In this case, the copying operation is not prohibited. However, it is possible to prohibit the copying operation while displaying the alarm message.

The alarming means is not limited to message display, and it is also possible to generate a buzzer sound or a voice message.

However, when data "000***" designating that response is not needed is transmitted, the alarm message described above is not displayed regardless of whether or not the transmission data from the cartridge CPU 45***f* is received.

If the alarm message is to be displayed in this case, it makes it difficult to decrypt the encrypting rule, and even if no alarm message is displayed, no problem occurs as far as the non-guaranteed toner cartridge is used only for a short period of time.

Furthermore, when a serial communication sync clock transmitted from the cartridge CPU 45*f* is not obtained within 100 msec from the start of communication, or when a sync clock in the standby mode is not received for a period of 50 msec or more, it is determined that the toner cartridge 45 is not mounted in the PPC 2.

Then, no data is transmitted, and a message representing this fact, e.g., "Please set a toner cartridge." is read out from the ROM 82 and displayed on the LCD 18*e* of the operation panel 18.

This aims at disturbing decryption of the encrypting rule by combining detection of non-mounting of the toner cartridge 45 and designation of response not needed. In this case, the message described above is displayed, and the copying operation is prohibited.

When no transmission data is sent back from the cartridge CPU 45*f* in response to transmission of data other than "000***" although a sync signal can be received, it is determined that the toner cartridge 45** is not mounted, in the same manner as described above.

Various other types of encrypting rules can be set regarding communication with the cartridge CPU 45*f*. However, once the power supply is turned on, the preset rule is not changed until the power supply is turned off. This aims at preventing the encrypting rules from being decrypted by not publicizing the rules as many as possible.

In this embodiment, the encrypting rule employed when the power supply is turned on is determined in accordance with the number of operating times of turning on/off the main switch and the total copy count at the turn-on/off operation. Therefore, if the turn-on/off operations of the switch are repeated without performing a copying operation at all, the argument of the second word is changed at a rate of once per four turn-on/off operating times, and the command (first word) is changed by 64 turn-on/off operating times. Hence, in order to obtain all the transmission data, 1,024 turn-on/off operating times of the switch are needed.

In fact, when the copying operation is performed, the copy count of 256 corresponds to one turn-on/off operating time of the power supply. Hence, a very complicated structure is provided to check all the transmission data without any omission.

To determined the rule, the color of the toner T or other data in the non-volatile memory of the control section 81 can be used.

While a message, e.g., "Use a correct cartridge for a high quality." or "Copy enabled." is displayed on the LCD 18*e* of the operation panel 18, if it is determined that a copy start signal is input by a turn-on operation of the print key 18*a* (step ST51), the copying operation described above is executed (step ST52).

When the end of copying operation is determined (step ST53), the flow advances to step ST48, and the respective processing operations (steps ST48 and ST49, or steps ST48, ST50, ST51, ST52, and ST53) are repeated.

If it is not determined in step ST51 that a copy start signal is input, whether the front cover of the PPC 2 is open (door open state) is checked (step ST54).

If a door open state is not determined, the flow advances to step ST48, and the subsequent processing operations are repeated.

If a door open state is determined, after the front cover is closed (step ST55), the flow advances to step ST44, and the subsequent processing operations are repeated.

As described above, according to the present invention, it is possible to warn the user of the use of a toner cartridge whose performance is not guaranteed by the PPC manufacturer.

More specifically, the toner cartridge is provided with a control PC board for generating encrypted data in accordance with a command from the control section of the PPC and sending back the encrypted data. The conformability of the toner cartridge is confirmed by communication with the cartridge CPU. Thus, a cartridge identification system which is relatively inexpensive and not easily imitated can be built up without bearing the cost of molds necessary for mechanical change in shape. When a similar toner cartridge is erroneously used, or when a non-guaranteed toner cartridge whose performance is not guaranteed by the PPC manufacturer is used, the PPC cannot provide its original performance, and, e.g., a defective image may be formed, the internal portion of the copying machine may be abnormally soiled, or the heat roller and the like may be damaged. Various types of these troubles caused by a defective toner can be easily avoided by the cartridge identification system of the present invention, and a constantly good stable operation can be guaranteed.

The above embodiment exemplifies a case in which the user is merely warned of the use of a toner cartridge other than the standard product. In fact, however, in order to actually avoid the occurrence of the trouble and to realize a stable operation, warning alone will not provide a sufficiently satisfactory effect.

Another embodiment (modification) of the present invention that may provide a higher effect will be described.

Figure 15:
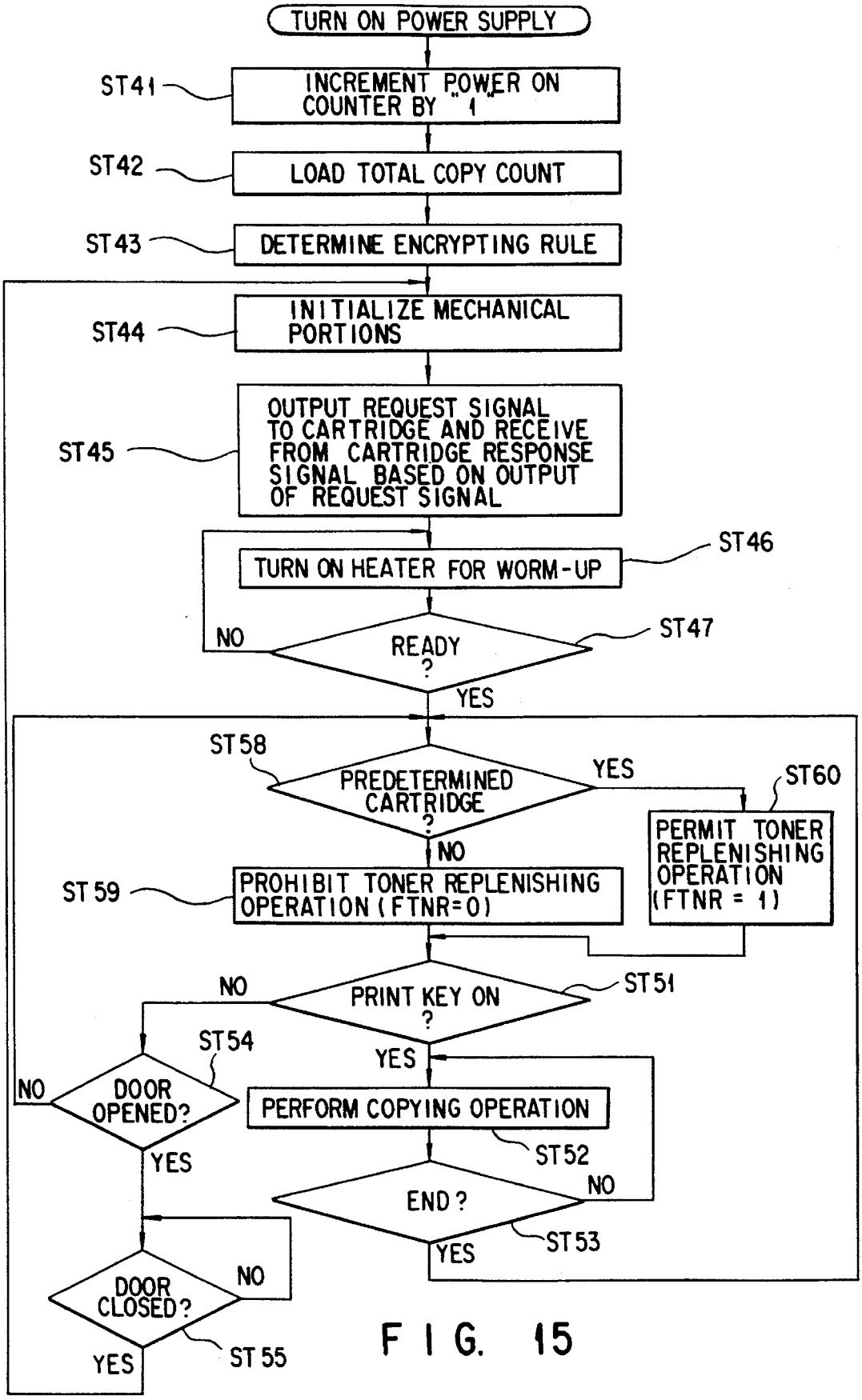
FIG. 15 is a flow chart for schematically explaining the flow of the processing for the identification operation of the toner cartridge according to another embodiment of the present invention.

FIG. 15 is different from FIG. 14 only in the processing operations corresponding to steps ST48, ST49, and ST50 of FIG. 14. Thus, only these different portions will be described.

More specifically, the control section 81 discriminates the conformability of the toner cartridge 45 from the content of the transmission data from the cartridge CPU 45*f*, e.g., it discriminates whether or not the mounted toner cartridge 45 is the standard product permitted by the PPC 2 (step ST58).

If it is determined that the mounted toner cartridge 45 is other than a predetermined one, the rotation of the toner convey motor is stopped in order to prohibit replenishment of the toner T from the toner cartridge 45 to the developing unit 44. In this case, "0" is set in, e.g., a toner replenishing operation setting flag (FTNR) assigned in the memory of the control section 81 (step ST59).

If it is determined that the predetermined toner cartridge 45 is mounted, the rotation of the toner convey motor is permitted in order to execute replenishment of the toner T from the toner cartridge 45. In this case, "1" is set in, e.g., the toner replenishing operation setting flag (FTNR) (step ST60).

In this manner, the operation of replenishing the toner from the toner cartridge 45 to the developing unit 44 is controlled in accordance with whether or not the mounted toner cartridge 45 is a standard product.

Figure 16:
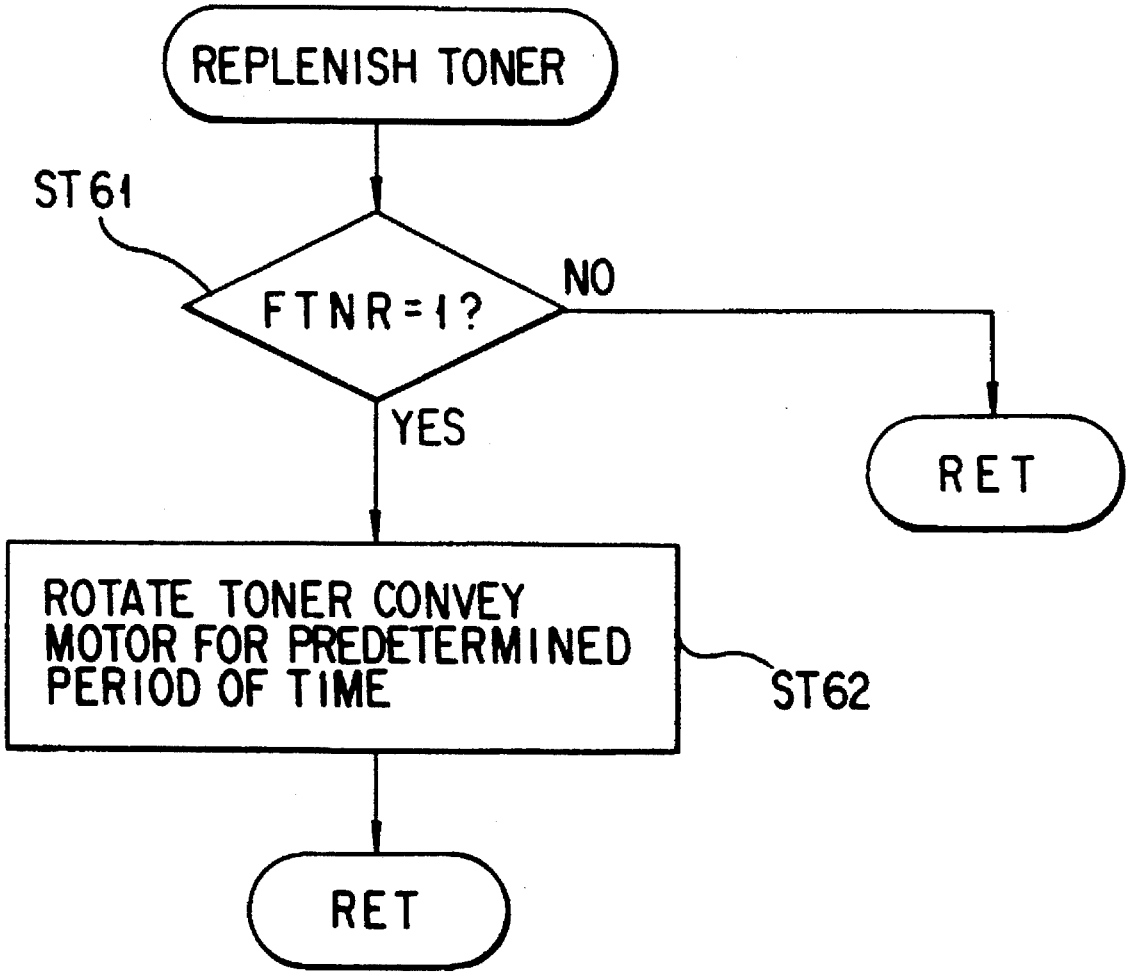
FIG. 16 is a flow chart for explaining the main part of the flow of the processing for the toner replenishing operation.

FIG. 16 shows the flow of the processing of the toner replenishing operation.

For example, assume that a decrease in toner density in the developing unit 44 which is detected by the toner density sensor 44*h* is informed by an input from the input section 83.

The value of the toner replenishing operation setting flag (FTNR) is referred to (step ST61), and the rotation of the toner convey motor is controlled in accordance with the reference result.

More specifically, when the value of the toner replenishing operation setting flag (FTNR) is "1", the driver section 84 is driven by the control section 81, and thus replenishment of the toner T in the toner cartridge 45 to the developing unit 44 is executed (step ST62).

On the other hand, when the value of the toner replenishing operation setting flag (FTNR) is "0, the toner convey motor is not rotated, and even if toner replenishment is needed, the toner T in the toner cartridge 45 is not replenished to the developing unit 44.

In this manner, when the mounted toner cartridge 45 is a non-guaranteed cartridge whose performance is not guaranteed by the manufacturer of the PPC 2, or is a non-conforming cartridge not conforming to the standard of the PPC 2, the use of this toner cartridge 45 is prohibited finally.

As a result, various types of troubles such as: a degradation in image caused when a toner for selenium which is electrically negatively charged is erroneously replenished to a copying apparatus that should use a toner for OPC which is electrically positively charged; insufficient fixing and an insufficient density which are caused when a toner for low-speed fixing is replenished where a toner capable of high-speed fixing should be used; an occurrence of a defective image, e.g., color mixing, caused when a color toner, e.g., red, is replenished to a black toner; toner scattering; carrier dragging; and the like can be reliably prevented.

Furthermore, a degradation in performance caused when a toner cartridge other than the predetermined one is used, and an occurrence of a trouble, e.g., an abnormal soiling or damage to the internal portion of the copying apparatus, can be prevented.

In this case, the copying operation is not immediately prohibited, because a toner replenishment operation is usually started before the toner in the developing unit 44 becomes less than the copy enable limit amount and a normal copying operation can be continued until then.

The present invention is not limited to an arrangement for permitting/prohibiting the toner replenishing operation from the discrimination result of the conformability of the toner cartridge 45. When the sync clock for serial communication transmitted from the cartridge CPU 45*f* is not obtained within 100 msec from the start of communication, or when the sync clock in the standby mode is not received for a period of 50 msec or more, it is determined that the toner cartridge 45 is not mounted in the main body of the PPC 2, and the toner replenishing operation is prohibited.

In this case, the occurrence of noise of, e.g., a motor caused by an unnecessary toner replenishing operation can be prevented.

In this embodiment, the operation of replenishing the toner from the toner cartridge to the developing unit can be controlled in accordance with whether or not a toner cartridge the use of which in the main body of the apparatus is permitted is mounted. Therefore, an undesired toner replenishing operation can be prohibited. An occurrence of various types of troubles caused when a toner cartridge other than the predetermined one is used, and noise generated when an unnecessary toner replenishing operation is performed while no toner cartridge is mounted, can be reliably prevented. An occurrence of noise or a defective image caused when a toner cartridge is not mounted or is erroneously mounted can be reliably suppressed. Therefore, stable copying performance can be maintained.

In the embodiment described above, the toner cartridge is provided with the CPU, and conformability of the toner cartridge and the like is discriminated from communication between the CPU and the copying apparatus. However, the present invention is not limited to this, and conformability of the toner cartridge and the like can be discriminated from, e.g., combinations of contact switches.

The present invention is not limited to the two-component type developing unit, and can similarly be applied to a one-component type developing unit.

Various other changes and modifications may naturally be made without departing from the spirit and scope of the invention.

We claim:

1. An image forming apparatus having a developing device designed to develop an electrostatic latent image formed on an image carrier, by supplying a developing agent onto the electrostatic latent image, characterized by comprising:

a developing-agent replenishing device detachably connected to said developing device and comprising:

a storage section for storing a developing agent;

a supply section for supplying the developing agent from said storage section to said developing device;

first input means for receiving a first data signal;

memory means storing a plurality of processing rules based on which the first data signal input through said first input means is is to be processed;

processing means for performing a processing on the first data signal input from said first input means, based on the processing rules stored in said memory means, thereby to generate a second data signal; and a first output means for outputting the second data signal generated by said processing means; and generating means for generating data for selecting a specific one of the plurality of processing rules stored in said memory means;

second output means for outputting to said first input means the data generated by said generating means for selecting the specified one of the plurality of processing rules and also the first data signal when said developing-agent replenishing device is connected to said developing device;

second input means for receiving the second data signal generated by said processing means and output from said first output means, when said developing agent replenishing device is connected to said developing device; and discriminating means for comparing the second data signal input through said second input means with the first data signal, thereby to discriminating conformability of said developing-agent replenishing device, when said developing-agent replenishing device is connected to said developing device.

2. An image forming apparatus according to claim 1, characterized in that when the first data signal and the second data signal are different, said discriminating means determines that said developing-agent replenishing device is not conformable.

3. An image forming apparatus according to claim 1, characterized by further comprising control means for inhibiting said supply section of said developing-agent replenishing device from supplying the developing agent to said developing device when said discriminating means determines that said developing-agent replenishing device connected to said developing device is not conformable.

4. An image forming apparatus having a developing device designed to develop an electrostatic latent image formed on an image carrier, by supplying a developing agent onto the electrostatic latent image, characterized by comprising:

a developing-agent replenishing device detachably connected to the developing device and comprising:

a storage section for storing a developing agent;

a supply section for supplying the developing agent from said storage section to said developing device;

first input means for receiving a data signal which has a command part and a data part;

first memory means storing a plurality of processing rules which correspond to types of the command part of the first data signal and based on which the data part of the first data signal is to be processed;

processing means for reading the processing rule corresponding to the type of the command part of the first data and for performing a prescribed processing based on the processing rules read out, on the first data signal input through said input means, thereby to generate a second data signal; and first output means for outputting the second data signal generated by said processing means;

second output means for outputting the first data signal having the command part and the data part to said first input means;

second memory means storing a third data signal corresponding to the command part of the first data signal output from said second output means;

second input means for receiving the second data signal generated by the processing means and output form said first output means; and comparing means for comparing the second data signal input from said second input means with the third data signal corresponding to the command part of the first data signal and stored in said memory means; and discriminating means for discriminating conformability of said developing-agent replenishing device in accordance with result of comparison performed by said comparing means.

5. An image forming apparatus according to claim 4, characterized in that when the second data signal and the third data signal are found to be different as a result of the comparison performed by said comparing means, said discriminating means determines that said developing-agent replenishing device is not conformable.

6. An image forming apparatus according to claim 4, characterized in that when the second data signal is not input to said second input means, the discriminating means determines that said developing-agent replenishing device is not conformable.

7. An image forming apparatus comprising:

exposure means for exposing to light an original placed on an original table;

latent-image forming means for forming a latent electrostatic image of the original on an image carrier by guiding the image from the original placed on said original table and exposed to light by means of said exposure means;

developing means having a storage chamber for containing a developing agent and designed to applying the developing agent from said storage chamber onto the latent electrostatic image formed on said image carrier, thereby to develop the image;

detector means contained in the storage chamber of said developing means and designed to detect an amount of the developing agent stored in said storage chamber;

a developing-agent replenishing device comprising a storage section detachably connected to said developing means, for storing the developing agent, a supply section for supplying the developing agent from said storage section into the storage chamber of said developing means, first input means for receiving a first data signal, memory means storing a plurality of processing rules based on which the first data signal input through said first input means is to be processed, processing means for performing a processing on the first data signal input from said first input means, based on the processing rules stored in said memory means, thereby to generate a second data signal, and first output means for outputting the second data signal generated by said processing means;

generating means for generating data for selecting a specific one of the plurality of processing rules stored in said memory means;

second output means for outputting to said first input means the data generated by said generating means for selecting the specified one of the plurality of processing rules and also the first data signal when said developing-agent replenishing device is connected to said developing device;

second input means for receiving the second data signal generated by said processing means and output from said first output means, when said developing-agent replenishing device is connected to said developing device;

discriminating means for comparing the second data signal input through said second input means with the first data signal, thereby to discriminating conformability of said developing-agent replenishing device, when said developing-agent replenishing device is connected to said developing device; and control means for causing said supply section to supply the developing agent to the storage chamber of said developing means when said discriminating means determines that said developing-agent replenishing device connected to said developing device is conformable and when said detector means detects that the amount of the developing agent stored in the storage chamber of said developing means has decreased, and for inhibiting said supply section from supplying the developing agent to said developing device, regardless of the result of the detection performed by said detector means, when said discriminating means determines that said developing-agent replenishing device connected to said developing device is not conformable.

* * * * *